US011172702B2

(12) United States Patent
Novak, III et al.

(10) Patent No.: US 11,172,702 B2
(45) Date of Patent: Nov. 16, 2021

(54) APPARATUS FOR MANUFACTURING A SMOKELESS TOBACCO PRODUCT INCORPORATING AN OBJECT, AND ASSOCIATED METHOD

(71) Applicant: R.J. Reynolds Tobacco Company, Winston-Salem, NC (US)

(72) Inventors: Charles J. Novak, III, Winston-Salem, NC (US); David Charles Bovender, Walnut Cove, NC (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 635 days.

(21) Appl. No.: 16/017,648

(22) Filed: Jun. 25, 2018

(65) Prior Publication Data

US 2018/0295872 A1 Oct. 18, 2018

Related U.S. Application Data

(62) Division of application No. 12/874,420, filed on Sep. 2, 2010, now Pat. No. 10,028,520.

(51) Int. Cl.
*A24B 13/00* (2006.01)
*B65B 29/00* (2006.01)
(Continued)

(52) U.S. Cl.
CPC ..... *A24B 13/00* (2013.01); *B65B 9/213* (2013.01); *B65B 29/00* (2013.01); *B65B 61/28* (2013.01)

(58) Field of Classification Search
None
See application file for complete search history.

(56) References Cited

U.S. PATENT DOCUMENTS 1,376,586 A 5/1921 Schwartz
3,339,558 A 9/1967 Waterbury
(Continued)

FOREIGN PATENT DOCUMENTS

EP 0 138 649 A 4/1985
JP 59-38794 A 3/1984
(Continued)

OTHER PUBLICATIONS

Nestor, et al. "Role of Oxides of Nitrogen in Tobacco-Specific Nitrosamine Formation in Flue-Cured Tobacco", Beitrage zur Tabakforschung International/Contributions to Tobacco Research, Nov. 2003, pp. 467-475. vol. 20 No. 7.
(Continued)

*Primary Examiner* — Michael J Felton
(74) *Attorney, Agent, or Firm* — Womble Bond Dickinson (US) LLP

(57) ABSTRACT

An apparatus and associated method are provided for manufacturing a smokeless tobacco product including tobacco material and at least one object. A forming unit is configured to form a continuous supply of a pouch material into a continuous tubular member defining a longitudinal axis. A tobacco insertion unit is configured to introduce tobacco material into a pouch member portion of the tubular member. An object insertion unit is configured to introduce objects into the tubular member, with at least one of the objects being introduced into the pouch member portion. A closing and dividing unit is configured to close and divide the tubular member at intervals along the longitudinal axis thereof, to form the tubular member into a plurality of discrete pouch member portions such that each discrete pouch member portion includes the tobacco material and the at least one of the objects.

7 Claims, 17 Drawing Sheets

(51) Int. Cl.
*B65B 9/213* (2012.01)
*B65B 61/28* (2006.01)

(56) References Cited

U.S. PATENT DOCUMENTS

| | | | |
|---|---|---|---|
| 3,390,686 | A | 7/1968 | Irby, Jr. et al. |
| 3,550,598 | A | 12/1970 | McGlumphy et al. |
| 3,685,521 | A | 8/1972 | Dock |
| 3,696,917 | A | 10/1972 | Levi |
| 3,916,914 | A | 11/1975 | Brooks et al. |
| 4,513,756 | A | 4/1985 | Pittman et al. |
| 4,528,993 | A | 7/1985 | Sensabaugh, Jr. et al. |
| 4,607,479 | A | 8/1986 | Linden |
| 4,624,269 | A | 11/1986 | Story et al. |
| 4,631,899 | A | 12/1986 | Nielsen |
| 4,660,577 | A | 4/1987 | Sensabaugh et al. |
| 4,703,765 | A | 11/1987 | Paules et al. |
| 4,889,144 | A | 12/1989 | Tateno et al. |
| 4,949,766 | A | 8/1990 | Coastworth |
| 4,987,907 | A | 1/1991 | Townend |
| 4,991,599 | A | 2/1991 | Tibbetts |
| 5,092,352 | A | 3/1992 | Sprinkle, III et al. |
| 5,167,244 | A | 12/1992 | Kjerstad |
| 5,223,185 | A | 6/1993 | Takei et al. |
| 5,346,734 | A | 9/1994 | Wydick, Jr. |
| 5,387,093 | A | 2/1995 | Takei |
| 5,387,416 | A | 2/1995 | White et al. |
| 5,882,680 | A | 3/1999 | Suzuki et al. |
| 6,117,455 | A | 9/2000 | Takada et al. |
| 6,162,516 | A | 12/2000 | Derr |
| 6,631,722 | B2 | 10/2003 | MacAdam et al. |
| 6,668,839 | B2 | 12/2003 | Williams |
| 6,719,933 | B2 | 4/2004 | Nakamura et al. |
| 6,730,832 | B1 | 5/2004 | Dominguez et al. |
| 6,834,654 | B2 | 12/2004 | Williams |
| 6,887,307 | B1 | 5/2005 | Scott et al. |
| 6,895,974 | B2 | 5/2005 | Peele |
| 6,923,981 | B2 | 8/2005 | Leung et al. |
| 6,949,256 | B2 | 9/2005 | Fonkwe et al. |
| 6,953,040 | B2 | 10/2005 | Atchley et al. |
| 7,025,066 | B2 | 4/2006 | Lawson et al. |
| 7,032,601 | B2 | 4/2006 | Atchley et al. |
| 7,115,085 | B2 | 10/2006 | Deal |
| 7,694,686 | B2 | 4/2010 | Atchley et al. |
| 7,754,239 | B2 | 7/2010 | Mane et al. |
| 7,757,835 | B2 | 7/2010 | Garthaffner et al. |
| 2004/0020503 | A1 | 2/2004 | Williams |
| 2004/0118422 | A1 | 6/2004 | Lundin et al. |
| 2004/0224020 | A1 | 11/2004 | Schoenhard |
| 2004/0261807 | A1 | 12/2004 | Dube et al. |
| 2005/0061339 | A1 | 3/2005 | Hansson et al. |
| 2005/0115580 | A1 | 6/2005 | Quinter et al. |
| 2005/0196437 | A1 | 9/2005 | Bednarz et al. |
| 2005/0244521 | A1 | 11/2005 | Strickland et al. |
| 2005/0249676 | A1 | 11/2005 | Scott et al. |
| 2006/0130855 | A1 | 6/2006 | Zhaohua et al. |
| 2006/0144412 | A1 | 7/2006 | Mishra et al. |
| 2006/0191548 | A1 | 8/2006 | Strickland et al. |
| 2006/0272663 | A1 | 12/2006 | Dube et al. |
| 2007/0012327 | A1 | 1/2007 | Karles et al. |
| 2007/0062549 | A1 | 3/2007 | Holton, Jr. et al. |
| 2007/0068540 | A1 | 3/2007 | Thomas et al. |
| 2007/0186941 | A1 | 8/2007 | Holton, Jr. et al. |
| 2007/0186942 | A1 | 8/2007 | Strickland et al. |
| 2008/0029110 | A1 | 2/2008 | Dube et al. |
| 2008/0029116 | A1 | 2/2008 | Robinson et al. |
| 2008/0029117 | A1 | 2/2008 | Mua et al. |
| 2008/0173317 | A1 | 7/2008 | Robinson et al. |
| 2008/0196730 | A1 | 8/2008 | Engstrom et al. |
| 2008/0209586 | A1 | 8/2008 | Nielsen et al. |
| 2008/0302373 | A1 | 12/2008 | Stockes et al. |
| 2008/0305216 | A1 | 12/2008 | Crawford et al. |
| 2009/0065013 | A1 | 3/2009 | Essen et al. |
| 2009/0293889 | A1 | 12/2009 | Kumar et al. |
| 2010/0018539 | A1 | 1/2010 | Brinkley et al. |
| 2010/0101588 | A1 | 4/2010 | Boldrini et al. |
| 2010/0184576 | A1 | 7/2010 | Prestia et al. |
| 2012/0060446 | A1 | 3/2012 | Merz |

FOREIGN PATENT DOCUMENTS

| | | | |
|---|---|---|---|
| JP | 08-322538 | A | 12/1996 |
| WO | WO 03/009711 | A1 | 2/2003 |
| WO | WO 2004/095959 | A1 | 11/2004 |
| WO | WO 2006/120570 | A2 | 11/2006 |
| WO | WO 2006/136197 | A1 | 12/2006 |
| WO | WO 2006/136199 | A1 | 12/2006 |
| WO | WO 2007/010407 | A2 | 1/2007 |
| WO | WO 2007/037962 | A | 4/2007 |
| WO | WO 2007/060543 | A2 | 5/2007 |
| WO | WO 2008/062301 | A1 | 5/2008 |
| WO | WO 2008/114133 | A1 | 9/2008 |

OTHER PUBLICATIONS

De Roton et al. "Factors Influencing the Formation of Tobacco-Specific Nitrosamines in French Air-Cured Tobacco in Trials and at the Farm Level", Beitrage zur Tabakforschung International/Contributions to Tobacco Research, Jul. 2005, pp. 305-320, vol. 21 No. 6.

Staaf et al. "Formation of Tobacco-Specific Nitrosamines (TSNA) During Air-Curing: Conditions and Control", Beitrage zur Tabakforschung International/Contributions to Tobacco Research Jul. 2005, pp. 321-330, vol. 21 No. 6.

Iwamoto et al. "Preparation of Gelatin Microbeads With a Narrow Size Distribution Using Microchannel Emulsification", AAPS PharmSciTech, 2002, pp. 1-5, Article 25.

"Opinion of the Scientific Panel on Food Additives, Flavourings, Processing Aids and Materials in Contact with Food on a request from the Commission related to . . . " The EFSA Journal, 2004 pp. 1-32, vol. 85.

APPARATUS FOR MANUFACTURING A SMOKELESS TOBACCO PRODUCT INCORPORATING AN OBJECT, AND ASSOCIATED METHOD

CROSS-REFERENCE TO RELATED APPLICATIONS

This application is a divisional of U.S. application Ser. No. 12/874,420, filed Sep. 2, 2010, which is hereby incorporated by reference in its entirety.

BACKGROUND OF THE DISCLOSURE

Field of the Disclosure

The present disclosure relates to products made or derived from tobacco, or that otherwise incorporate tobacco, and are intended for human consumption. In particular, aspects of the present disclosure relate to apparatuses and methods for manufacturing smokeless tobacco products incorporating one or more objects, and, more particularly, to apparatuses and methods for inserting one or more objects into a smokeless tobacco product, such as a snuff product.

Description of Related Art

Cigarettes, cigars and pipes are popular smoking articles that employ tobacco in various forms. Such smoking articles are used by heating or burning tobacco, and aerosol (e.g., smoke) is inhaled by the smoker. Tobacco may be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,668,839 to Williams; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Breslin et al.; US Pat. Pub. Nos. 2004/0020503 to Williams; 2005/0115580 to Quinter et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; and 2009/0293889 to Kumar et al.; PCT WO 04/095959 to Arnarp et al.; and U.S. patent application Ser. No. 12/638,394, filed Dec. 15, 2009, to Mua et al.; each of which is incorporated herein by reference. Exemplary smokeless tobacco products include CAMEL Snus, CAMEL Orbs, CAMEL Strips and CAMEL Sticks by R.J. Reynolds Tobacco Company; REVEL Mint Tobacco Packs and SKOAL Snus by U.S. Smokeless Tobacco Company; and MARLBORO Snus and Taboka by Philip Morris USA.

Representative smokeless tobacco products have been marketed under the trade names Oliver Twist by House of Oliver Twist A/S; Copenhagen, Skoal, SkoalDry, Rooster, Red Seal, Husky, and Revel by U.S. Smokeless Tobacco Co.; "taboka" by Philip Morris USA; and Levi Garrett, Peachy, Taylor's Pride, Kodiak, Hawken Wintergreen, Grizzly, Dental, Kentucky King, Mammoth Cave by Conwood Sales Co., L.P., Interval by Brown & Williamson Tobacco Corp., and Ariva and Stonewall by Star Scientific, Inc.

One type of smokeless tobacco product is referred to as "snuff." Snuff typically is formulated in "moist" or "dry" forms. Representative types of snuff products, commonly referred to as "snus," are manufactured in Europe, particularly in Sweden, by or through companies such as Swedish Match AB, Fiedler & Lundgren AB, Gustavus AB, Skandinavisk Tobakskompagni A/S and Rocker Production AB. Snus products available in the U.S.A. are marketed under the trade names Camel Snus Frost, Camel Snus Original and Camel Snus Spice by R.J. Reynolds Tobacco Company. Snus products, such as Camel Snus Original, are commonly supplied in small teabag-like pouches. The pouches are typically a nonwoven fleece material, and contain about 0.4 to 1.5 grams of pasteurized tobacco. These products typically remain in a user's mouth for about 10-30 minutes. Unlike certain other smokeless tobacco products, snus products do not require expectoration by the user.

Some users might desire a smokeless tobacco product that is capable of providing, in some instances, selectively, a variety of different flavors, depending upon the user's immediate desire. The flavor of such a smokeless tobacco product might be selected based on the user's desire for a particular flavor at that time, or a desire to change flavors during use. For example, changing flavors during use may enable a user to end the experience with a breath freshening flavor, such as menthol or spearmint. Accordingly, it would be desirable to provide a smokeless tobacco product that is capable of providing distinctive, different pleasurable sensory experiences, for a user. Some users might also desire a smokeless tobacco product that is capable of modifying the nature or character of the by-product generated by that smokeless tobacco product.

In this regard, tobacco products can incorporate objects, beads, capsules and capsule components such as those set forth in US Patent Publication Nos. 2006/0272663 to Dube et al., 2006/01330961 to Luan et al., 2006/0144412 to Mishra et al.; 2007/0012327 to Karles et al.; 2007/0068540 to Thomas et al.; and 2008/0029110 to Dube et al.; PCT WO 2006/136197; PCT WO 2006/136199; PCT WO 2007/010407 PCT WO 2007/060543 and U.S. Pat. No. 7,115,085 to Deal; and U.S. patent application Ser. No. 11/760,983 to Stokes et al. and Ser. No. 12/775,892 to Carpenter et al., as well as within filtered cigarettes that have been marketed under the tradenames "Camel Lights with Menthol Boost" and "Camel Crush" by R.J. Reynolds Tobacco Company. Exemplary pelletized carrier materials and flavor packages are of the type employed in cigarettes that have been marketed commercially in the USA. For example, flavor-carrying pellets have been incorporated into cigarette filters employed on Camel brand cigarettes under the tradenames Mandalay Lime, Mandarin Mint, Breach Breezer, Back Ally Blend, Snakeyes Scotch, Izmir Stinger, Kauai Kolada, Midnight Madness, Aegean Spice, Screwdriver Slots, Twist, Twista Lime, Dark Mint and Blackjack Gin; Kool brand cigarettes under the tradenames Flow and Groove; and Salem brand cigarettes under the tradename Deep Freeze; all of which have been marketed by R.J. Reynolds Tobacco Company.

It would be further desirable to provide a user with the ability to enhance a sensory aspect of his/her smokeless tobacco experience, and the extent or magnitude of that sensory experience, such as can be accomplished by allowing the user to purposefully select a smokeless tobacco product having certain characteristics or behaviors and, in some instances, by allowing the user to determine the magnitude or extent of such characteristics or behaviors that the smokeless tobacco product exhibits. That is, it would be desirable to provide a smokeless tobacco product possessing components that can be employed so as to allow the user to select a smokeless tobacco product based on an indicated character or nature and, in some instances, allow the user to control, whether selectively or not, the nature or character of the by-product produced by that smokeless tobacco product, and the source from which it is obtained. In particular, it would be desirable to provide a smokeless tobacco product that is capable of enhancing the sensory attributes, and the extent or magnitude of such attributes, of the by-product (e.g., by flavoring that by-product). More particularly, it would be desirable to provide the capability of manufacturing such smokeless tobacco products incorporating such flavor agents and sources, and the like, in a rapid, highly-automated fashion. It also would be desirable to provide improved provisions for incorporating product-altering solid objects such as flavor pellets, flavor capsules, flavored or non-flavored strands, or possibly various combinations thereof, into smokeless tobacco products, in a rapid, highly automated fashion.

BRIEF SUMMARY OF THE DISCLOSURE

The present disclosure relates to an apparatus and process for providing tobacco products in smokeless form, including those smokeless tobacco products characterized as "snus." The products include a powdered or granular smokeless tobacco formulation that is disposed within a moisture-permeable container. That is, the tobacco formulation can be contained within a container, such as a pouch or bag, such as is the type commonly used for the manufacture of snus types of products (e.g., a sealed, moisture permeable pouch that is sometimes referred to as a "portion"). A representative moisture permeable pouch can be composed of a "fleece" type of material. The smokeless tobacco formulation includes particles or pieces of tobacco, and may include other ingredients, such as salts, sweeteners, binders, colorants, pH adjusters, fillers, flavoring agents, disintegration aids, antioxidants, humectants, and preservatives. The moisture content of the particles of the tobacco may vary.

Also disposed within the container is at least one object, selected from, for example, rupturable capsules, pellets, strips, sheets, strands, or combinations thereof. A representative capsule aspect is generally spherical in shape, and has an outer cover or shell that may contain a liquid center region. The liquid center region, which is released when the outer shell undergoes some type of physical destruction, breakage, or other loss of physical integrity (e.g., through dispersion, softening, crushing, application of pressure, or the like), is thereby capable of altering the sensory properties of the smokeless tobacco product. In this regard, snus may be supplied in various flavors such as Camel Snus Frost and Camel Snus Spice. The snus may be flavored by mixing flavor into the tobacco, adding microcapsules or the like to the tobacco, or adding flavor strips to the tobacco. U.S. Pat. Pub. Nos. 2008/0029110 to Dube et al. and 2007/0186941 to Holton, Jr. et al. exemplarily describe such snus products, and are herein incorporated by reference in their entirety.

The container is intended to be placed in the mouth of the tobacco user, such that the tobacco formulation within the container may be enjoyed by the user. During use of the product, the outer shell of the capsule or other object within the container may be acted upon by moisture within the mouth of the user, broken, crushed, or otherwise acted upon to release its contents. After the tobacco user is finished using the smokeless tobacco product, the container may be removed from the user's mouth for disposal. In some instances, the container may be manufactured from a water dissolvable or dispersible material, such that the tobacco formulation and the container may be ingested by the user. Residual components of the outer shell of the capsule or other object may be dispersed within the mouth of the user for ingestion, or remain within the used container for disposal.

In particular, the present disclosure relates to an apparatus and process for providing pouch material formed into a tube for use in the manufacture of smokeless tobacco products, wherein the pouch material tube has one or more objects (e.g., rupturable capsules, pellets, strips, strands, or combinations thereof) disposed along its length such that, when the pouch material tube is subdivided into discrete pouch portions, each pouch portion includes at least one of such objects. The apparatus incorporates equipment for supplying a continuous supply of a pouch material (e.g., a pouch processing unit adapted to supply a pouch material to a continuous tube forming unit for forming a continuous tubular member from the pouch material). Representative equipment for forming such a continuous tube of pouch material is disclosed, for example, in U.S. Patent Application Publication No. US 2010/0101588 to Boldrini et al., which is incorporated herein by reference in its entirety. The apparatus further includes equipment for supplying tobacco material to the continuous tubular member such that, when the continuous tubular member is subdivided and sealed into discrete pouch portions, each pouch portion includes a tobacco charge. Representative equipment for supplying the tobacco material is disclosed, for example, in U.S. Patent Application Publication No. US 2010/0018539 to Brinkley, which is incorporated herein by reference in its entirety. The apparatus may include, for instance, an object insertion unit for inserting the objects into the continuous tubular member. In some instances, the apparatus may include a subdividing unit for subdividing the continuous tubular member into individual pouch portions and, once subdivided into the individual pouch portions, may also include a sealing unit for sealing at least one of the ends of each pouch portion. In other instances, the continuous tubular member may be sealed into individual pouch portions with a sealing unit and then, once the individual pouch portions are sealed, the continuous tubular member may be subdivided into discrete individual pouch portions by a subdividing unit subdividing the continuous tubular member between the sealed ends of serially-disposed pouch portions. Still in other instances, sealing (closing) of the individual pouch portions of the continuous tubular member may occur substantially concurrently with the subdivision thereof, using a closing and dividing unit.

In summary, the pouch material is formed into a continuous tubular member having tobacco material and the objects disposed therein and along the longitudinal axis thereof. The continuous tubular member is then subdivided at predetermined intervals so as to form a plurality of pouch member portions, wherein each pouch member portion includes the tobacco material and at least one of the objects therein. Accordingly, aspects of the present disclosure are particularly configured to provide the objects and tobacco material and to place the same within the pouch material, such that a desired arrangement of at least one object per pouch portion is obtained when the continuous tubular member is sealed into individual pouch portions and then subdivided to form discrete pouch portions.

Aspects of the present disclosure thus provide advantages as otherwise detailed herein.

BRIEF DESCRIPTION OF THE SEVERAL VIEWS OF THE DRAWING(S)

Having thus described the disclosure in general terms, reference will now be made to the accompanying drawings, which are not necessarily drawn to scale, and wherein:

Figure 21:
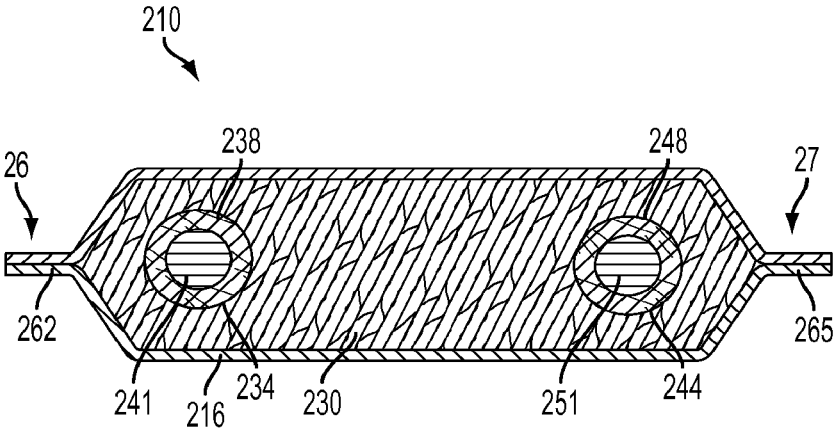
Figure 22:
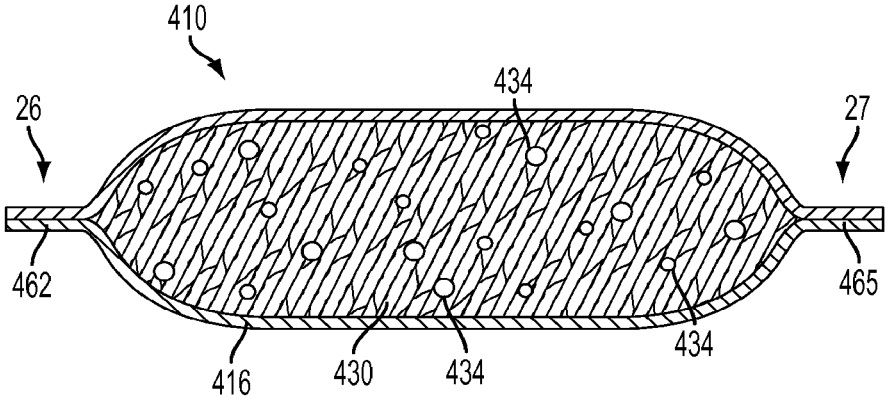

FIG. 21 is a cross-sectional schematic view of a smokeless tobacco product capable of being manufactured with aspects of the present disclosure, illustrating an individual pouch portion having tobacco material and a plurality of objects disposed therein; and FIG. 22 is a cross-sectional schematic view of a smokeless tobacco product capable of being manufactured with aspects of the present disclosure, illustrating an individual pouch portion having tobacco material and a plurality of microcapsules disposed therein.

DETAILED DESCRIPTION OF THE DISCLOSURE

The present disclosure now will be described more fully hereinafter with reference to the accompanying drawings, in which some, but not all aspects of the disclosure are shown. Indeed, this disclosure may be embodied in many different forms and should not be construed as limited to the aspects set forth herein; rather, these aspects are provided so that this disclosure will satisfy applicable legal requirements. Like numbers refer to like elements throughout.

Descriptions of various components of snus types of products and components thereof are set forth in U.S. Pat. App. Pub. No. 2004/0118422 to Lundin et al., which is incorporated herein by reference. See, also, for example, U.S. Pat. No. 4,607,479 to Linden; U.S. Pat. No. 4,631,899 to Nielsen; U.S. Pat. No. 5,346,734 to Wydick et al.; and U.S. Pat. No. 6,162,516 to Den, and U.S. Pat. App. Pub. No. 2005/0061339 to Hansson et al.; each of which is incorporated herein by reference. See, also, the representative types of pouches, and pouch material or fleece, set forth in U.S. Pat. No. 5,167,244 to Kjerstad, which is incorporated herein by reference.

Representative tobacco products may be manufactured using appropriately modified smokeless tobacco product manufacturing equipment. For example, a representative packaging machine, such as a Packaging Machine SB 53-2/T Forming-, Filling- and Sealing Machine from Merz Verpackungsmachinen GmbH may be suitably adapted for use with an object insertion device. G.D SpA of Italy also supplies tobacco pouching equipment. Snus pouches can be provided as individual pouches, or a plurality of pouches (e.g., 2, 4, 5, 10, 12, 15, 20, 25 or 30 pouches) can be connected or linked together (e.g., in an end-to-end manner) such that a single pouch or individual portion can be readily removed for use from a one-piece strand or matrix of pouches.

FIGS. 1-5 illustrate an apparatus for manufacturing smokeless tobacco products, incorporating one or more objects, according to one aspect of the present disclosure, the apparatus being indicated generally by the numeral 1. Such an apparatus 1 is configured to removably receive a first bobbin 10 on an unwind spindle assembly 15, the first bobbin 10 having a continuous length of a material, such as a pouch material 20, wound thereon. When the first bobbin 10 is engaged with the apparatus 1, the pouch material 20 is routed from the first bobbin 10 to a forming unit 50 configured to form a continuous supply of the pouch material 20 into a continuous tubular member 25 defining a longitudinal axis.

As such, as the pouch material 20 is unwound from the first bobbin 10, the pouch material 20 is directed around an arrangement of roller members 16, otherwise referred to herein as a dancer assembly 17. The forming unit 50 is configured to cooperate with the first bobbin 10 and the dancer assembly 17 to take up slack in the pouch material 20 and to maintain a certain amount of longitudinal tension on the pouch material 20 as the pouch material 20 is unwound from the first bobbin 10 and fed to the forming unit 50, for example, by a drive system. One of ordinary skill in the art will appreciate that, between the first bobbin 10 and the forming unit 50, the pouch material 20 may be supported, routed, and/or guided by a suitably aligned series of any number of, for example, idler rollers, guideposts, air bars, turning bars, guides, tracks, tunnels, or the like, for directing the pouch material 20 along the desired path. Typical bobbins used by conventional automated smokeless tobacco making apparatuses often contain a continuous strip of pouch material 20 of which the length may vary. As such, the apparatus 10 described herein may be configured so as to handle bobbins of that type and size.

The forming unit 50 may include one or more roller members 52 configured to direct the pouch material 20 about a hollow shaft 54 such that the continuous supply of the pouch material 20 can be formed into the continuous tubular member 25. The forming unit 50 may include a sealing device 60 configured to seal, fix, or otherwise engage the lateral edges of the pouch material 20 to form a longitudinally-extending seam, thereby forming the longitudinally-extending continuous tubular member 25. A tobacco insertion unit 300 is configured to introduce tobacco material into the continuous tubular member 25 through the hollow shaft 54. An object insertion unit 500 is configured to introduce objects into the continuous tubular member 25, also through the hollow shaft 54. The tobacco insertion unit 300 may be directly or indirectly engaged with the hollow shaft 54. Further, the object insertion unit 500 may be directly or indirectly engaged with the hollow shaft 54.

A leading edge or end 162 of the continuous tubular member 25 may be closed/sealed such that a charge of tobacco material and objects introduced by the tobacco insertion unit 300 and object insertion unit 500, respectively, are contained within the continuous tubular member 25 proximate to the leading end 162. The leading end 162 may be closed/sealed via a closing and dividing unit 600 configured to close/seal a first portion 26 (see FIGS. 20-22) of the continuous tubular member 25 to form the closed leading end 162 of a pouch member portion 116 (see FIG. 20). The closing and dividing unit 600 may also be configured to form a closed trailing edge or end 165 of a previous pouch member portion 116. In this regard, the closing and dividing unit 600 may also be configured to close a second portion 27 (see FIGS. 20-22) of the continuous tubular member 25 to form the closed trailing end 165 of the pouch member portion 116. The closing and dividing unit 600 may also be configured to form a closed leading edge 162 of a subsequent pouch member portion 116. That is, the closing and dividing unit 600 may be configured to close the trailing end 165 of one pouch member portion 116 while simultaneously closing the leading end 162 of a subsequent pouch member portion 116 formed from the continuous tubular member 25. In this regard, the closing and dividing unit 600 may close the ends 162, 165 by heat-sealing, a suitable adhesive, or other suitable sealing mechanism.

Figure 1:
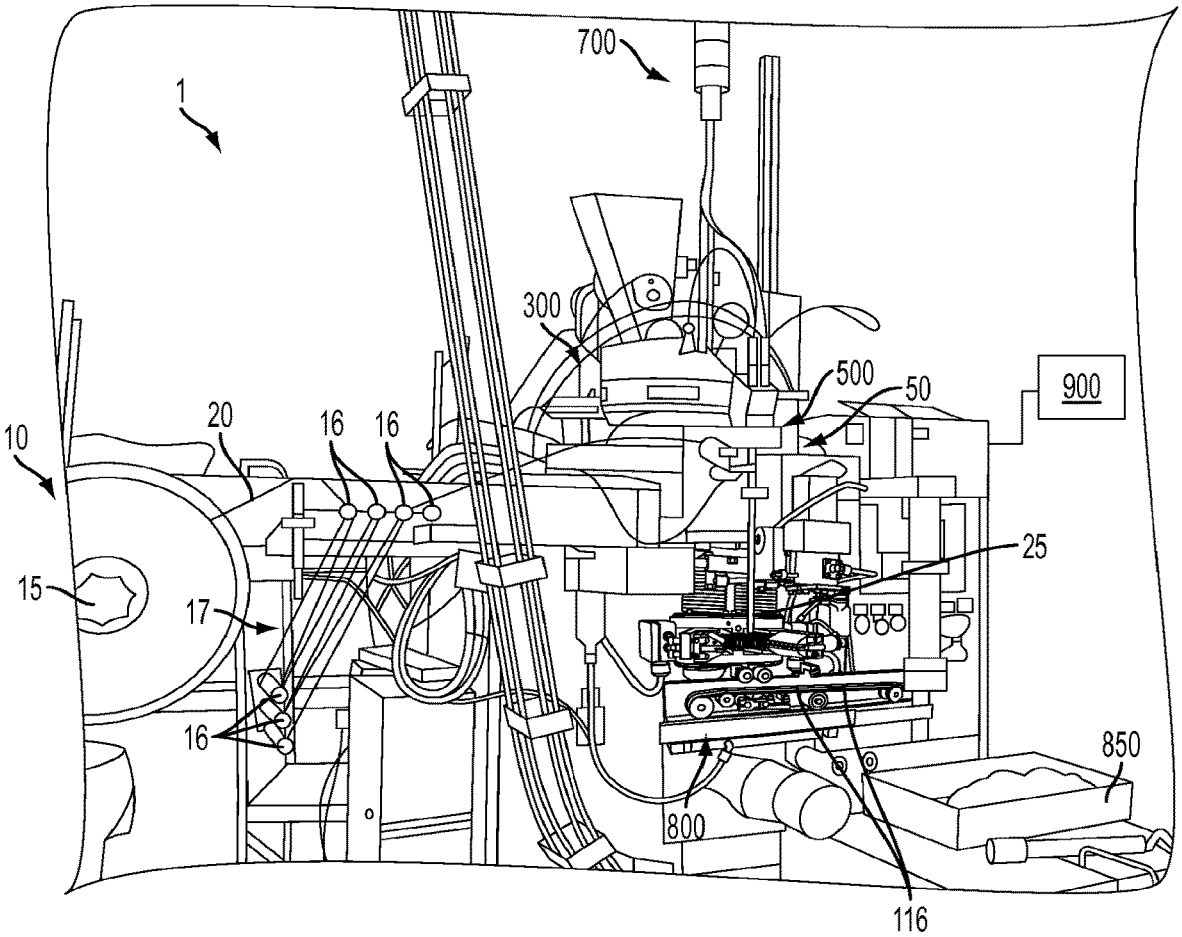
FIG. 1 is a perspective view of an apparatus for manufacturing a smokeless tobacco product incorporating one or more objects, according to one aspect of the present disclosure.
Figure 2:
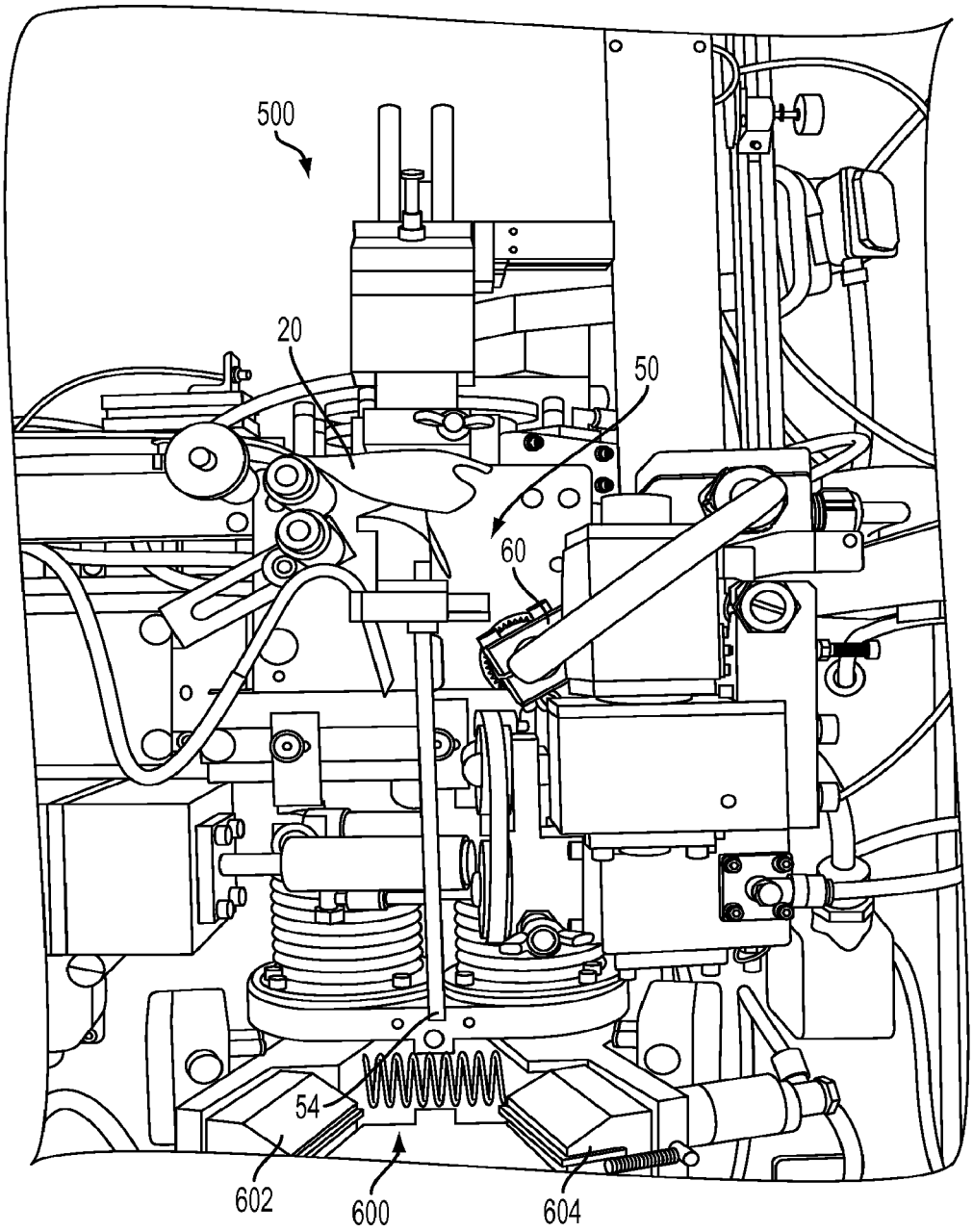
FIG. 2 is a sectional perspective view of the apparatus of FIG. 1.
Figure 3:
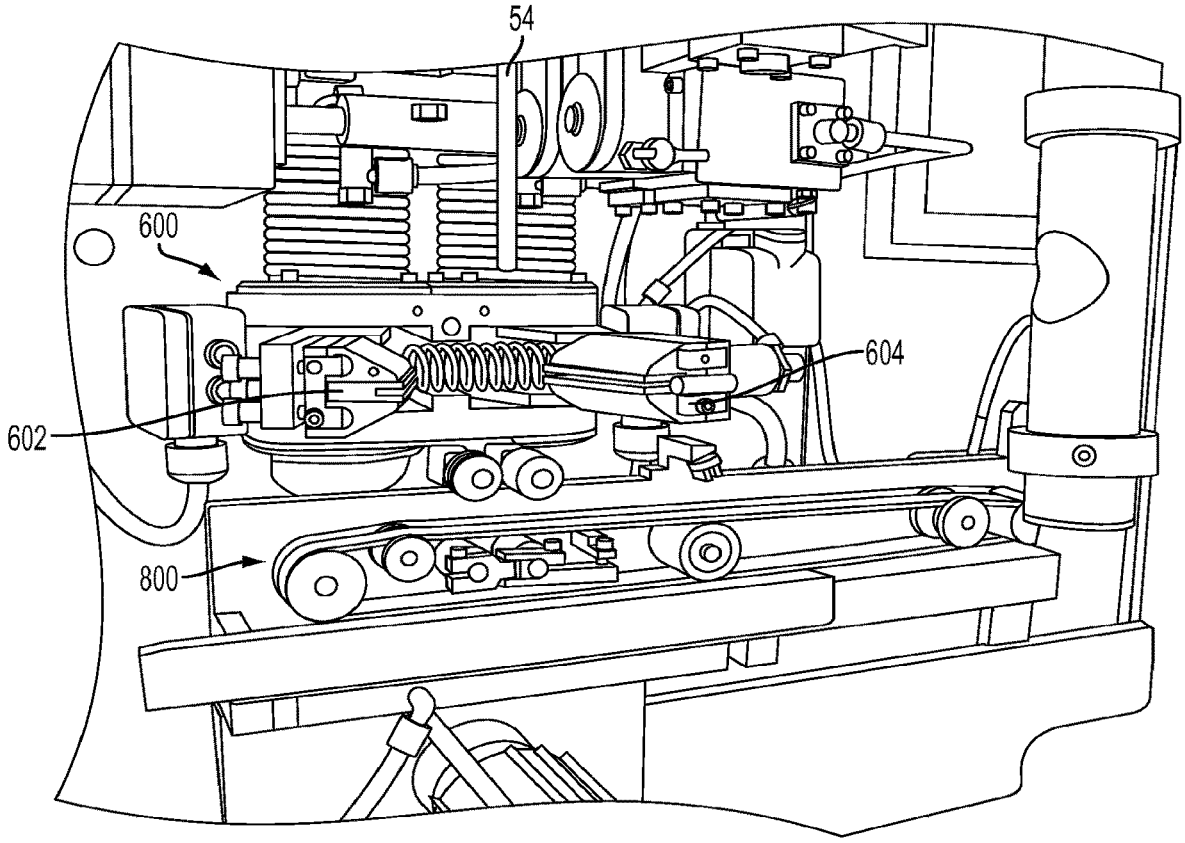
FIG. 3 is another sectional perspective view of the apparatus of FIG. 1.
Figure 4:
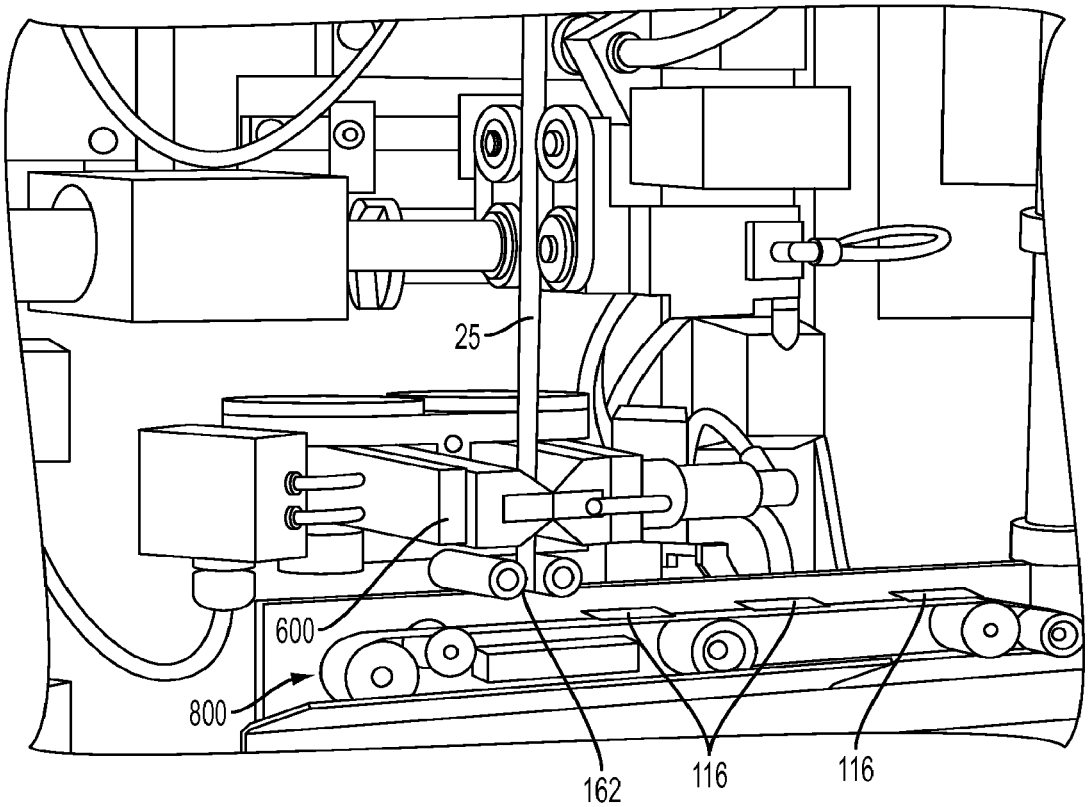
FIG. 4 is yet another sectional perspective view of the apparatus of FIG. 1, illustrating a continuous tubular member being sealed and subdivided into individual pouch portions.
Figure 20:
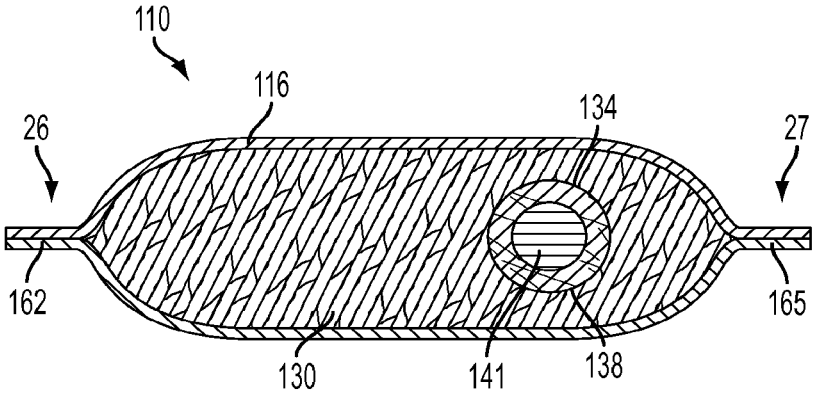
FIG. 20 is a cross-sectional schematic view of a smokeless tobacco product capable of being manufactured with aspects of the present disclosure, illustrating an individual pouch portion having tobacco material and an object disposed therein.

Furthermore, the closing and dividing unit 600 may be configured to divide the continuous tubular member 25, between the closed trailing end 165 and the closed leading end 162 of serially-disposed pouch member portions 116, along the longitudinal axis of the continuous tubular member 25, and into a plurality of discrete pouch member portions 116 such that each discrete pouch member portion 116 includes a portion of the tobacco material from the tobacco insertion unit 300 and at least one of the objects from the object insertion unit 500, as shown in FIGS. 20-22 and as described further herein. In this regard, the closing and dividing unit 600 may include a blade, heated wire, or other cutting arrangement for severing the continuous tubular member 25 into discrete pouch member portions 116. For example, the closing and dividing unit 600 may include first and second arm members 602, 604 configured to interact to close and divide the continuous tubular member 25, as generally shown in FIG. 4.

In operation, a charge of tobacco material (i.e., an amount suitable for an individual pouch member portion 116) is supplied to the pouch member portion 116 by the tobacco insertion unit 300 after the leading end 162 has been closed, but prior to the closing of the trailing end 165. Similarly, one or more objects is supplied to the pouch member portion 116 by the object insertion unit 500 after the leading end 162 has been closed, but prior to the closing of the trailing end 165. After receiving the charge of tobacco material and the one or more objects, the discrete individual pouch member portion 116 is formed by closing the trailing end 165 and severing the closed pouch member portion 116 from the continuous tubular member 25 such that an individual smokeless tobacco product, incorporating at least one object, is formed. In some instances, the apparatus 1 may be configured to produce approximately 300 pouch member portions 116 per minute. A conveyor assembly 800 may be provided proximate to the closing and dividing unit 600 such that, after being severed from the continuous tubular member 25, each individual pouch member portion 116 is received by the conveyor assembly 800 and transported away from the apparatus 1 to, for example, a storage bin or container 850. In some instances, each individual pouch member portion 116 may be transported to a counting device (not shown) capable of counting and depositing a predetermined quantity of individual pouch member portions 116 into, for example, a packaging container. A computer device 900 may provide a signal to the tobacco insertion unit 300 and/or the object insertion unit 500 to indicate when the charge of tobacco material and/or the object(s) should be directed into the continuous tubular member 25. That is, the computer device 900 may be used to control the timing of the insertion of the tobacco material and objects.

Figure 5:
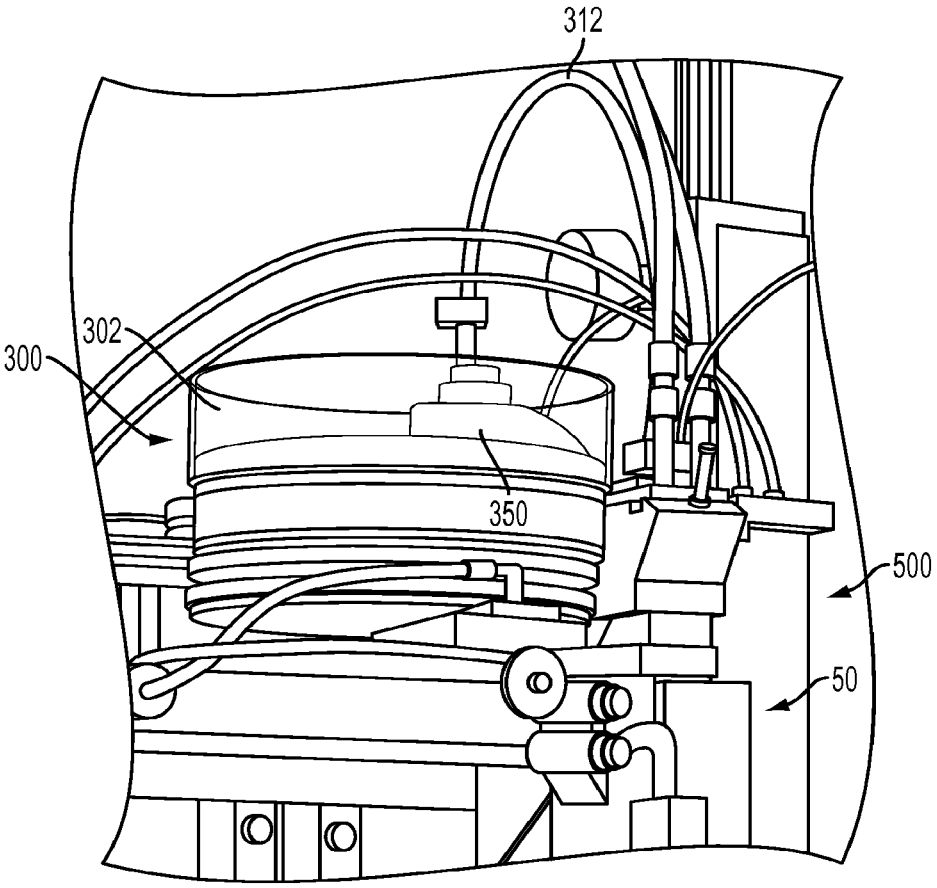
FIG. 5 is a sectional perspective view of the apparatus of FIG. 1, illustrating a tobacco insertion unit and an object insertion unit.
Figure 6:
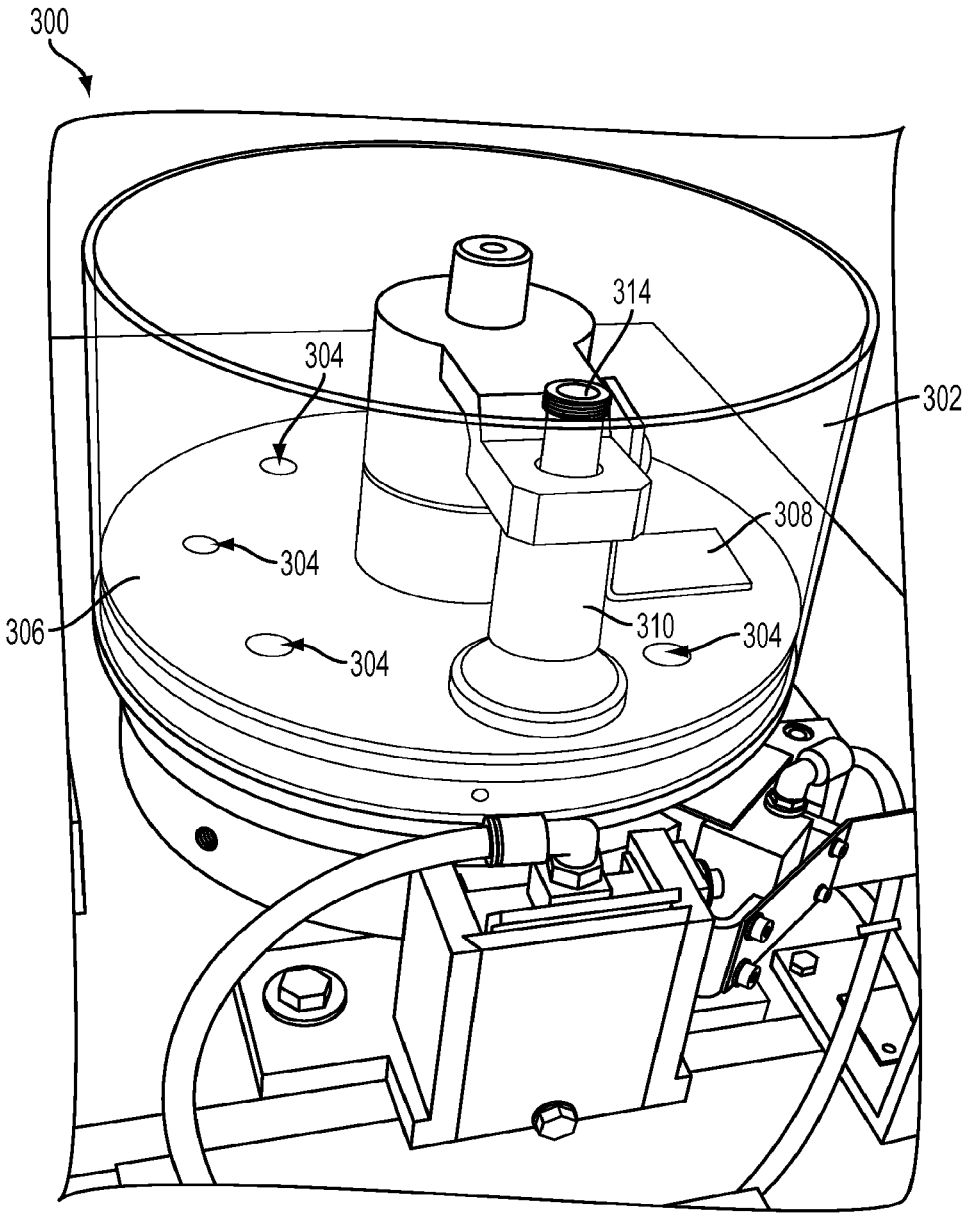
FIG. 6 is a perspective view of a tobacco insertion unit capable of being implemented in accordance with various aspects of the present disclosure.

As shown in FIGS. 5 and 6, the tobacco insertion unit 300 may be directly or indirectly engaged with the hollow shaft 54 such that a charge of tobacco can be delivered into the continuous tubular member 25 proximate to the leading end 162 thereof. The tobacco insertion unit 300 may include a tobacco hopper 302 for storing tobacco material 350. The tobacco hopper 302 may define a plurality of cavities 304 arranged in a substantially circular formation in a base 306 of the tobacco hopper 302. A packing arm member 308 may be rotatably engaged with the tobacco hopper 302. The packing arm member 308 may be used to displace the tobacco material 350 stored within the tobacco hopper 302 so as to urge the tobacco material 350 into the cavities 304. A charge delivery device 310 may be engaged with the tobacco hopper 302 so as to rotatable therein. In this regard, the charge delivery device 310 may be configured to serially move from one cavity 304 to a subsequent cavity 304 such that the charge delivery device 310 can receive the tobacco material 350 from each cavity 304 when a discharge of compressed air (e.g., about 90 psi) is delivered from underneath the cavities 304 so as to direct the tobacco material 350 into the charge delivery device 310, wherein the charge delivery device 310 can then direct the tobacco material 350 into the continuous tubular member 25. The timing and duration of the discharge of compressed air may be controlled by, for example, a mechanical valve (not shown), wherein the valve only engages a cavity 304 (i.e., supplies air to a cavity 304) when the valve is directly aligned with the charge delivery device 310.

In other aspects, the charge delivery device 310 may be stationary, while the tobacco hopper 302 is configured to rotate such that the cavities 304 align with the charge delivery device 310 in a serial manner. In any instance, the tobacco material 350 can be transported from the tobacco hopper 302 to the hollow shaft 54 via a tubular member 312 received within a port 314 of the charge delivery device 310 for the tobacco material 350 to be introduced into the continuous tubular member 25. In one instance, the tobacco material 350 may be transported to the continuous tubular member 25 with a force of about 90 psi.

Figure 7:
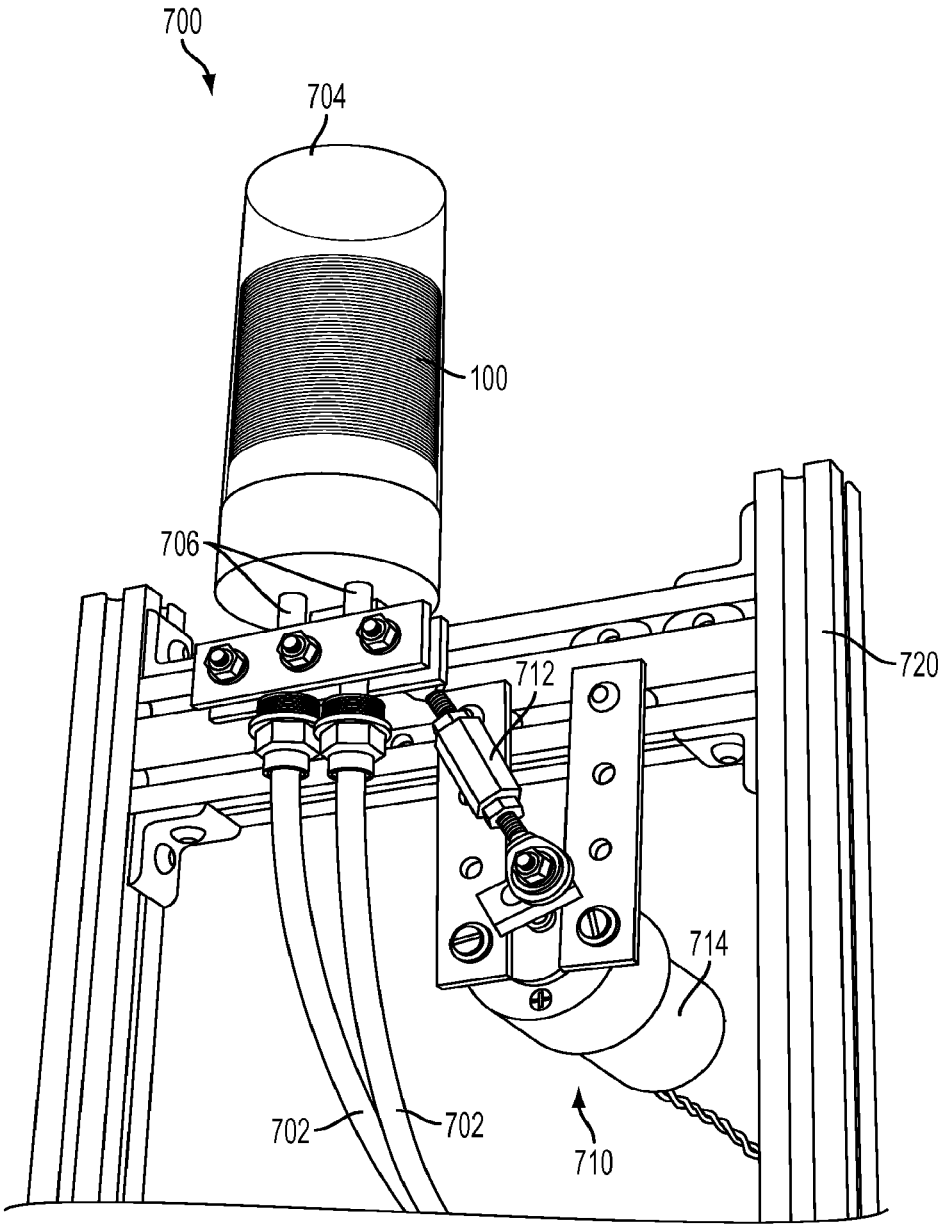
FIG. 7 is a sectional perspective view of the apparatus of FIG. 1, illustrating an object hopper assembly configured to feed objects to an object insertion unit.
Figure 8:
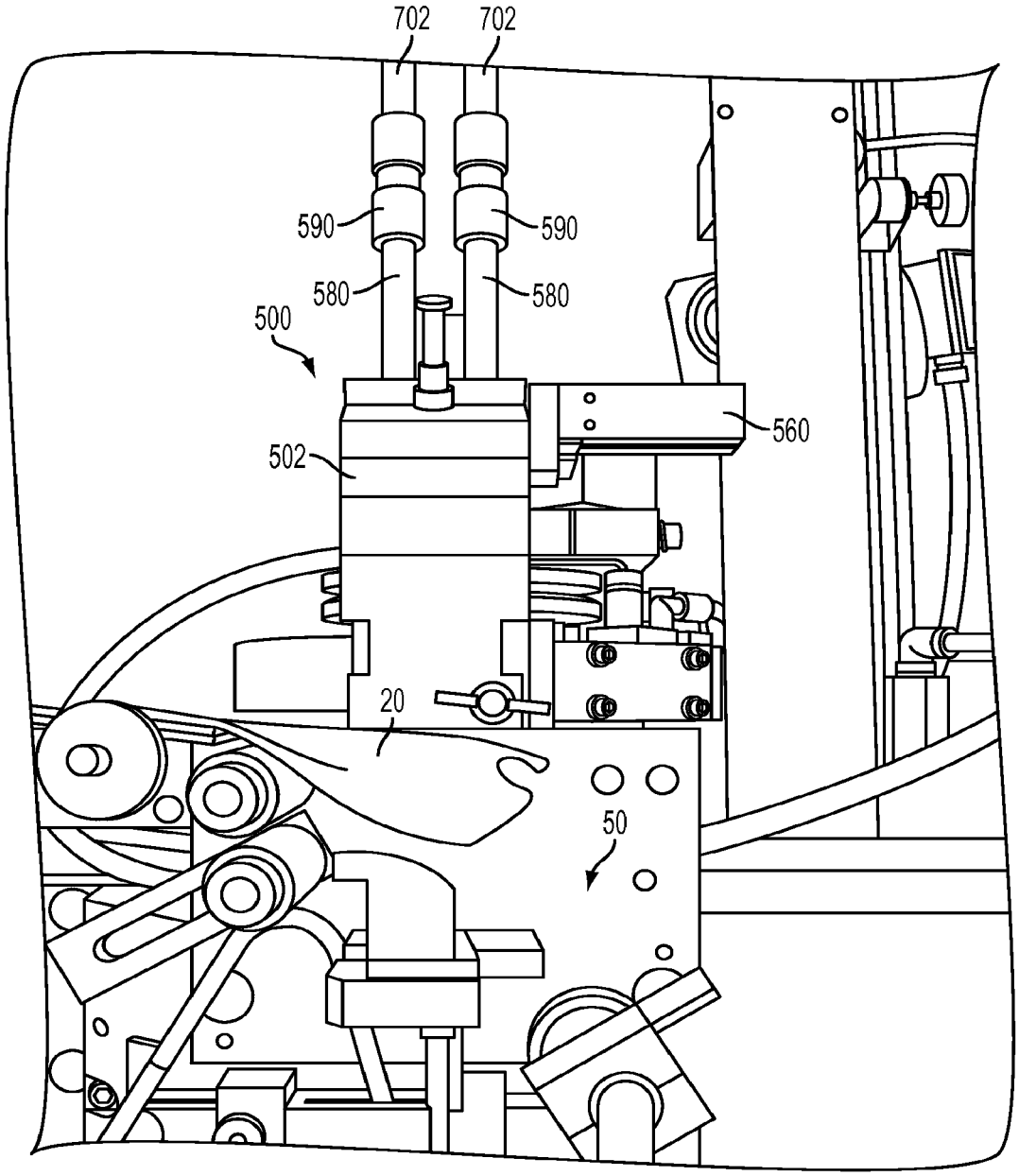
FIG. 8 is a sectional perspective view of the apparatus of FIG. 1, illustrating an object insertion unit configured to position objects within a continuous tubular member of pouch material.

As shown in FIG. 7, the apparatus 1 may include an object hopper assembly 700 for supplying objects 100 to the object insertion unit 500. According to one aspect, the object hopper assembly 700 employs gravity and agitation to feed the objects 100 from the object hopper assembly 700 to the object insertion unit 500 via one or more tubular transport members 702 connected therebetween. The object hopper assembly 700 may be mounted to a frame 720. The object hopper assembly 700 includes an object hopper 704 for receiving the objects 100. An agitation device 710 may be used to agitate or otherwise displace the objects 100 received within the object hopper 704 so as to facilitate delivery of the objects 100 into the tubular transport members 702. Further, connector tubes 706 may be incorporated at the upper ends of transport members 702 to improve the interaction between the transport members 702 with object hopper 704. These connector tubes 706 may be constructed of a rigid material, e.g. stainless steel, rigid polymer, etc., in order to maintain dimensional stability and facilitate axial displacement of connector tubes 706 and/or transport members 702 relative to the object hopper 704 which may occur as a result of agitation by device 710. Transport members 702 may be comprised of a flexible material, e.g. polyurethane, polyethylene, PTFE, etc., whereas flexure of the material allows for repeated physical displacement of distances between connector tubes 706, transport members 702, and/or object hopper 704 relative to fixed components located below, e.g. insertion unit 500, which also may occur as a result of agitation by device 710.

According to one aspect, the object hopper 704, connector tubes 706, and the tubular transport members 702 are coaxially disposed along a substantially vertical axis. The agitation device 710 may include an agitation arm member 712 which is driven by a motor 714. In this regard, the agitation arm member 712 of the agitation device 710 may oscillate the object hopper 704 or the connector tubes 706 with respect to the other along the substantially vertical axis such that the connector tubes 706 are oscillated to a minima below a fill level of the objects 100 within the object hopper 704. In this manner, the objects 100 may be urged into the connector tubes 706 and subsequently into the tubular transport members 702, so as to be directed toward the continuous tubular member 25 for insertion therein, upon oscillation of the connector tubes 706 toward the maxima.

As shown in FIGS. 8-18, the apparatus 1 may include an object insertion unit 500 for supplying objects into the continuous tubular member 25 such that at least one object is incorporated into each pouch member portion 116. The object insertion unit 500 may be directly or indirectly coupled to the hollow shaft 54 such that the objects can be transported into the hollow shaft 54 for insertion into the continuous tubular member 25. According to one aspect, the objects 100 may be transported from the object hopper 704 to the object insertion unit 500 via the one or more tubular transport members 702. In this regard, the object insertion unit 500 may include a body member 502 defining a tobacco channel 510 extending therethough from a tobacco inlet 512 and a tobacco outlet 514. The tobacco material 350 from the tobacco insertion unit 300 may thus pass through the tobacco channel 510 of the body member 502, which may be directly or indirectly engaged with the hollow shaft 54. The body member 502 may define an object channel 504 extending at least partially therein and connecting an object inlet 506 to the tobacco channel 510. In this regard, objects may be received at the object inlet 506 and transported to the tobacco channel 510.

Figure 15:
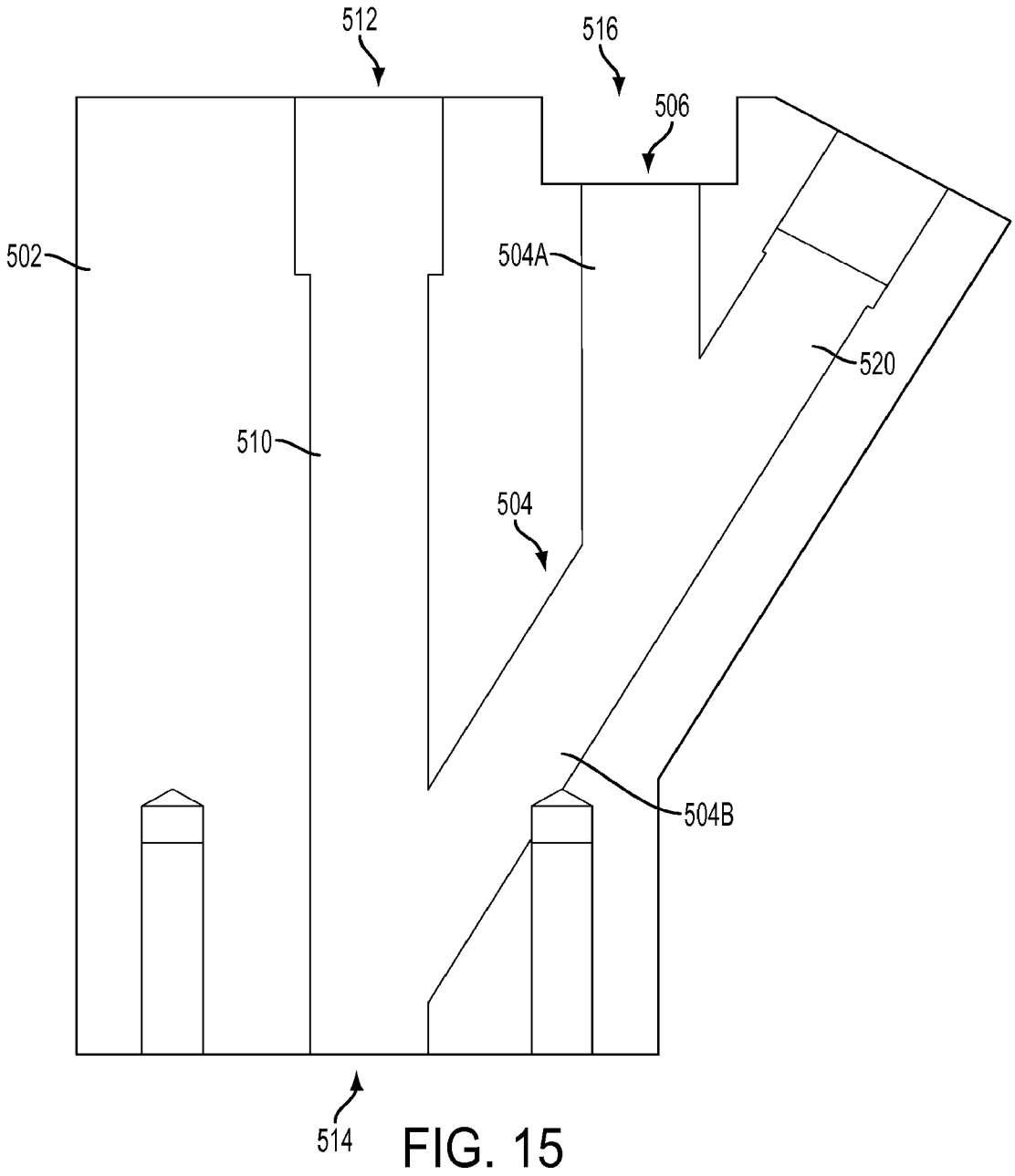
FIG. 15 is a side schematic view of a body member of an object insertion unit, with phantom lines illustrating the internal structure of the body member, according to one aspect of the present disclosure.
Figure 16:
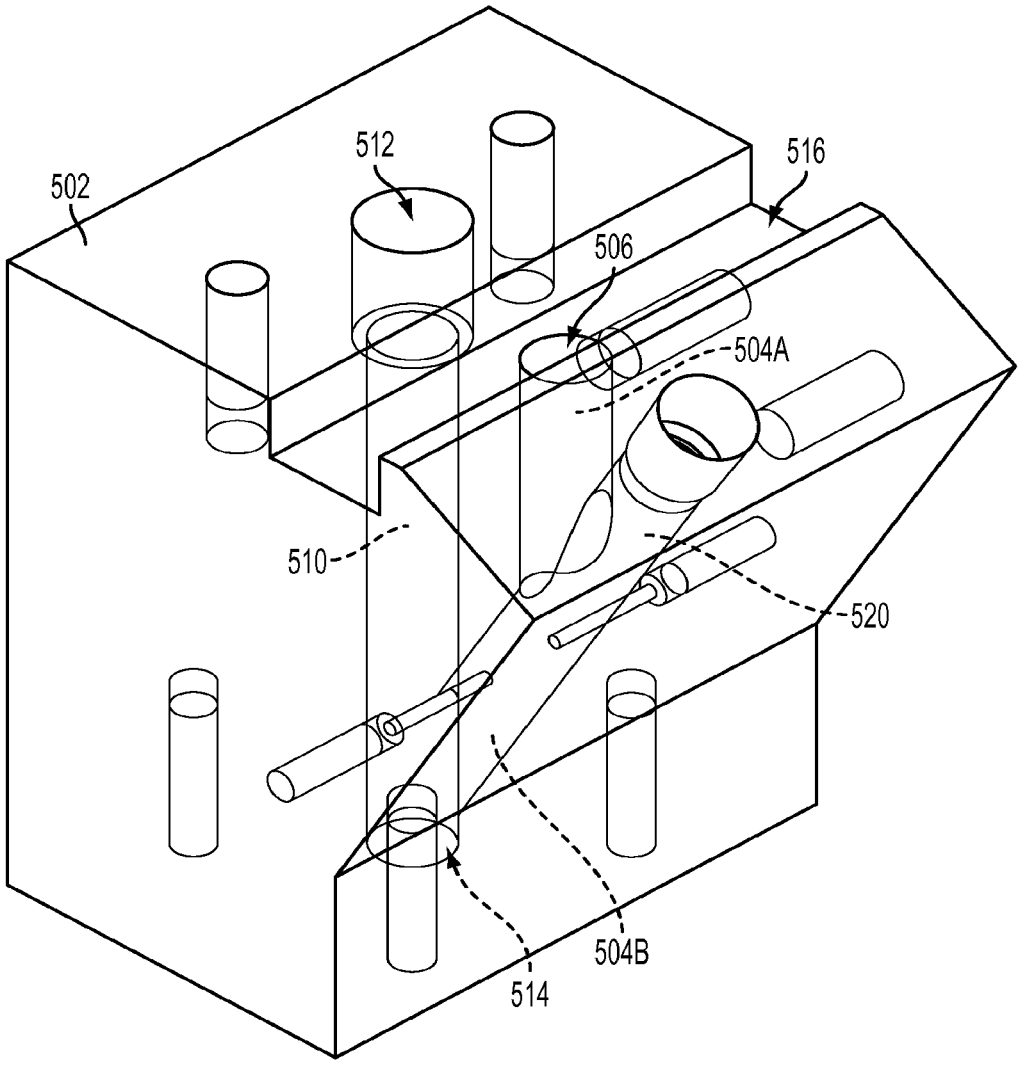
FIG. 16 is a schematic perspective view of a body member of an object insertion unit, with phantom lines illustrating the internal structure of the body member, according to one aspect of the present disclosure.

In some instances, the object channel 504 may be connected to or otherwise in communication with the tobacco channel 510 between the tobacco inlet 512 and the tobacco outlet 514. As such, the object channel 504 may be configured to receive the objects 100 via the object inlet 506 and provide a passageway for transporting the objects 100 to the tobacco channel 510. The tobacco channel 510 may be configured to receive the tobacco material 350 via the tobacco inlet 512 and the objects 100 via the object channel 504. The tobacco channel 510 may be further configured to transport the tobacco material 350 and the objects 100 to the tobacco outlet 514 for introduction into the continuous tubular member 25 via the hollow shaft 54. According to one aspect, the tobacco channel 510 may be linearly configured as defined by the body member 502 and the object channel 504 may be non-linearly configured. For example, as shown in FIG. 15, the object channel 504 may include an initial portion 504A extending from the object inlet 506 and into the body member 502, substantially parallel to the tobacco channel 510, with the initial portion 504A being in communication with a subsequent portion 504B extending within the body member 502 to converge with the tobacco channel 510. The initial and subsequent portions 504A, 504B, in communication with each other and the tobacco channel 510 thus provide a continuous, but nonlinear, passageway between the object inlet 506 and the tobacco channel 510. However, the configurations of the tobacco channel 510 and the object channel 504 can vary.

In one aspect, the body member 502 may define a first supplemental channel 520 configured to interconnect with the object channel 504 between the object inlet 506 and the tobacco channel 510 (i.e., about the interface between the initial and subsequent portions 504A, 504B). The first supplemental channel 520 may fluidly connect to a blower assembly or other source of pressurized air for discharging air into the first supplemental channel 520 so as to assist in moving the objects 100 from the initial portion 504A and through the subsequent portion 504B of the object channel 504, and into the tobacco channel 510. In some instances, the blower assembly may provide, for instance, approximately 20 psi of force to assist with directing the objects 100 toward the tobacco channel 510.

According to one aspect, the object inlet 506 may be disposed within a distribution channel 516 defined by the body member 502. In such an aspect, the object insertion unit 500 may also include a translating member 530 configured to be received within the distribution channel 516. The translating member 530 may be translatable or otherwise movable (i.e., laterally) within the distribution channel 516 along a longitudinal axis 540 of the translating member 530. In this regard, the translating member 530 can be moved between a first position and a second position, as particularly shown in FIGS. 17 and 18. The translating member 530 may also define first and second ports 532, 534 extending therethrough, wherein the first and second ports 532, 534 have parallel axes 533, 535 in perpendicular relation to the longitudinal axis 540 of the translating member 530 and are also spaced apart along the longitudinal axis 540.

Figure 9:
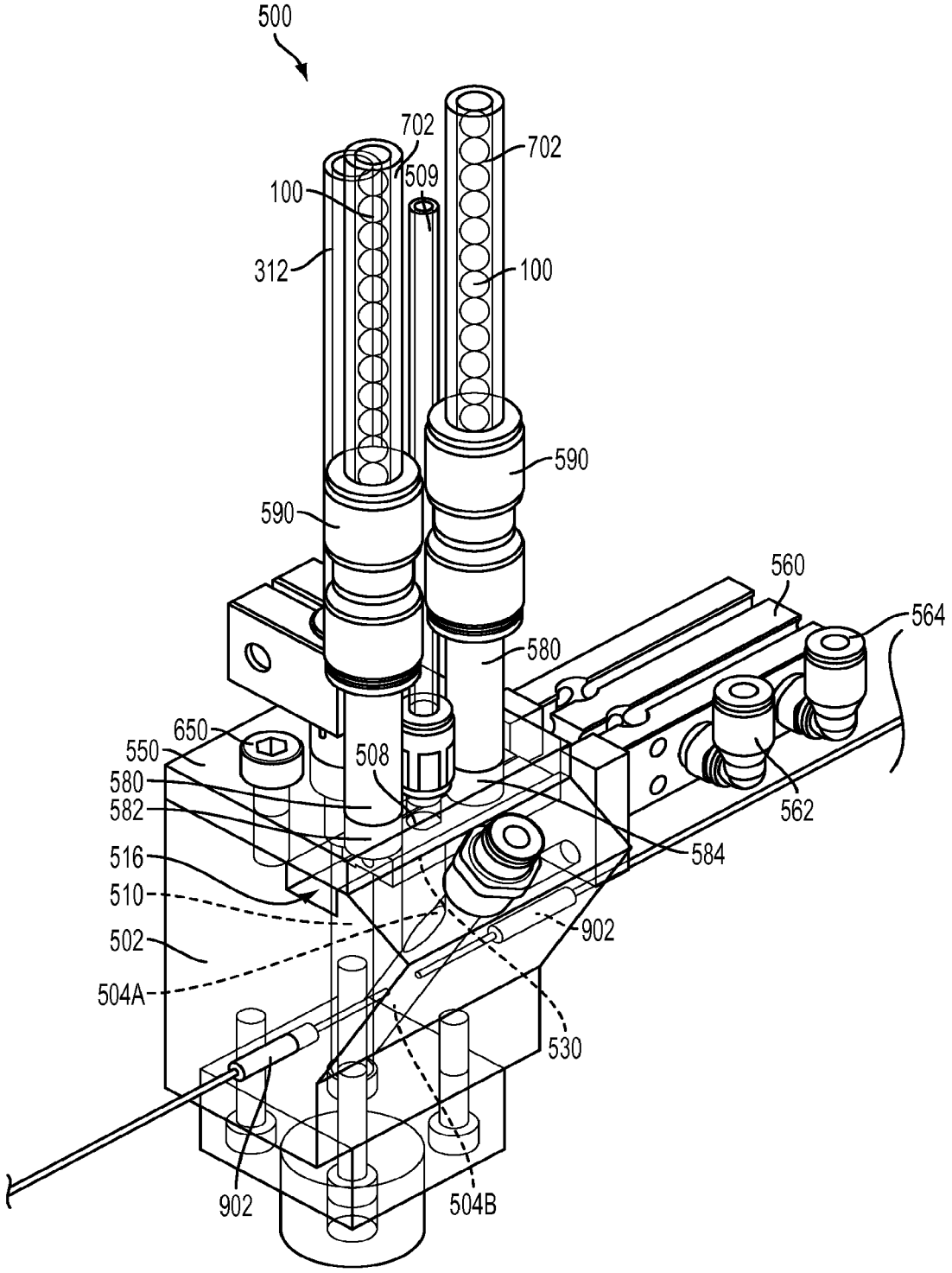
FIG. 9 is a schematic perspective view of an object insertion unit, according to one aspect of the present disclosure.
Figure 10:
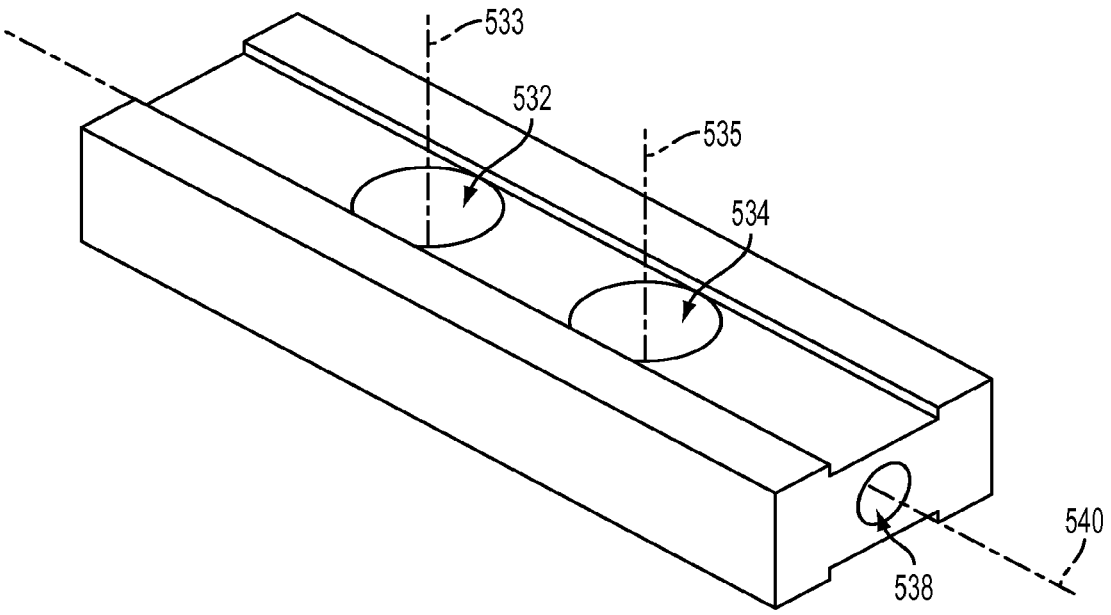
FIG. 10 is a schematic perspective view of a translating member for an object insertion unit, according to one aspect of the present disclosure.
Figure 11:
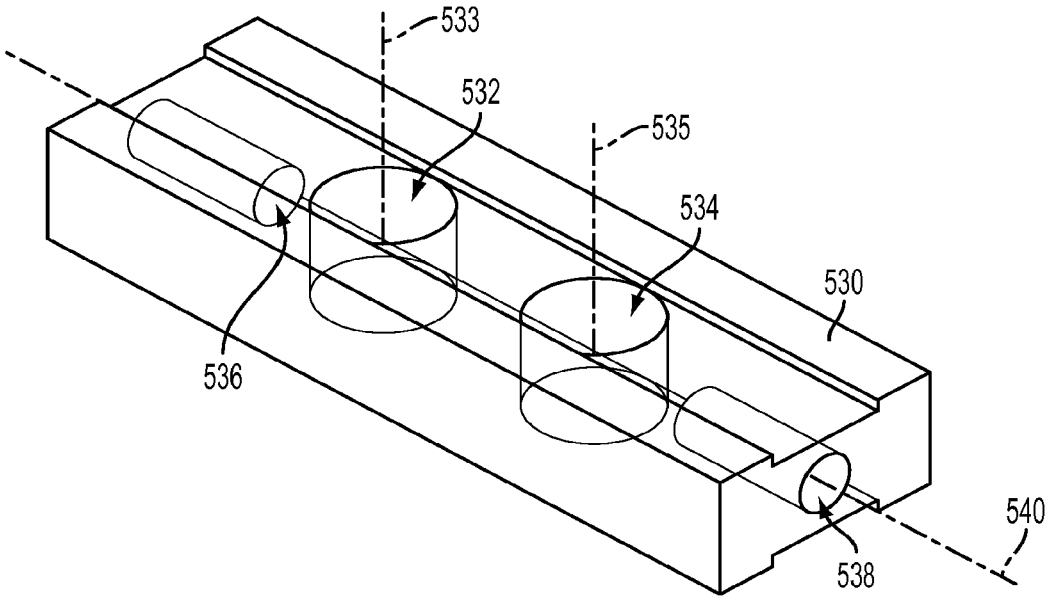
FIG. 11 is a schematic perspective view of a translating member for an object insertion unit, according to one aspect of the present disclosure, with phantom lines illustrating the internal structure of the translating member.
Figure 12:
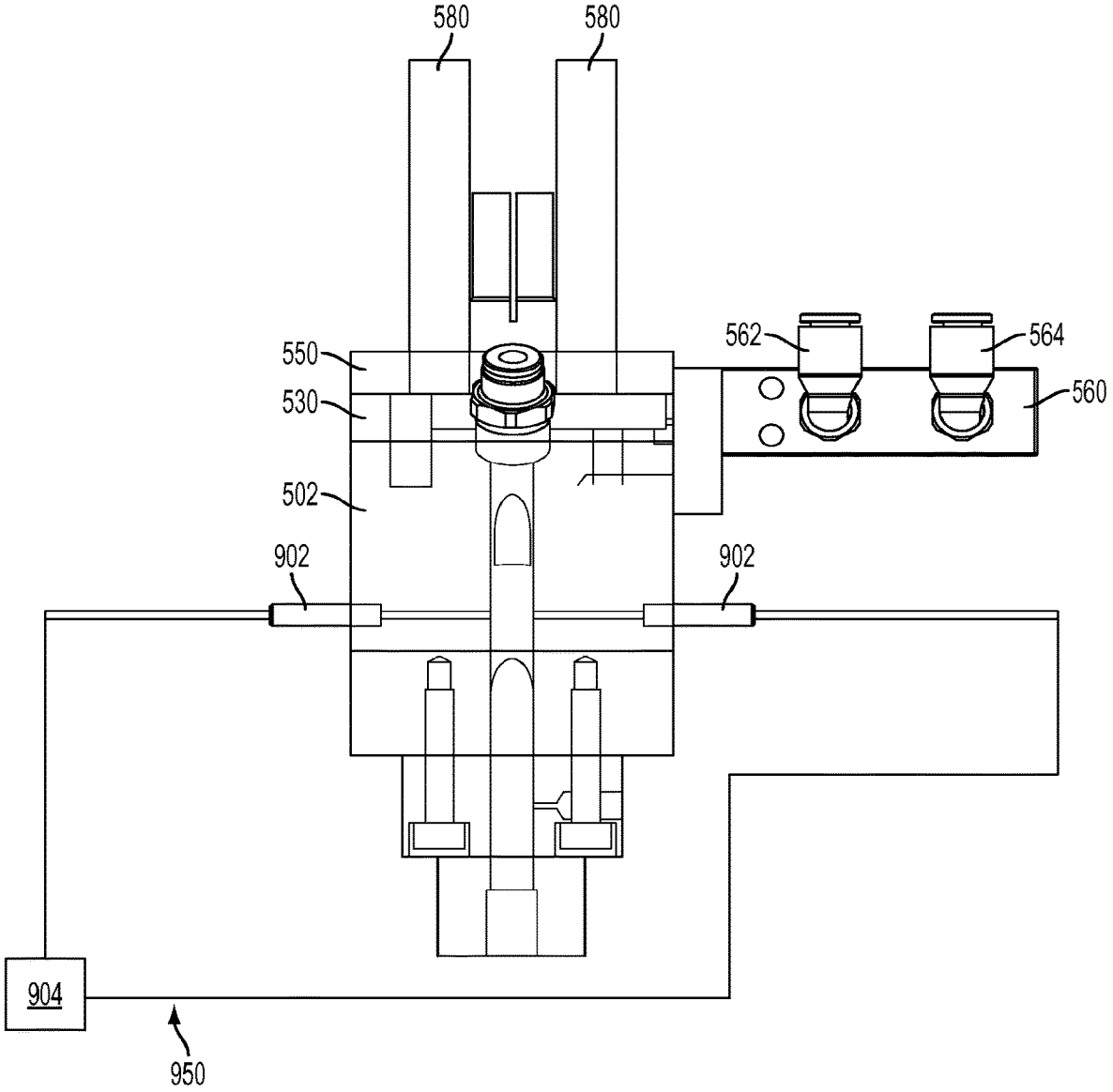
FIG. 12 is a front schematic view of the object insertion unit of FIG. 9, with phantom lines illustrating the internal structure and components of the object insertion unit.
Figure 13:
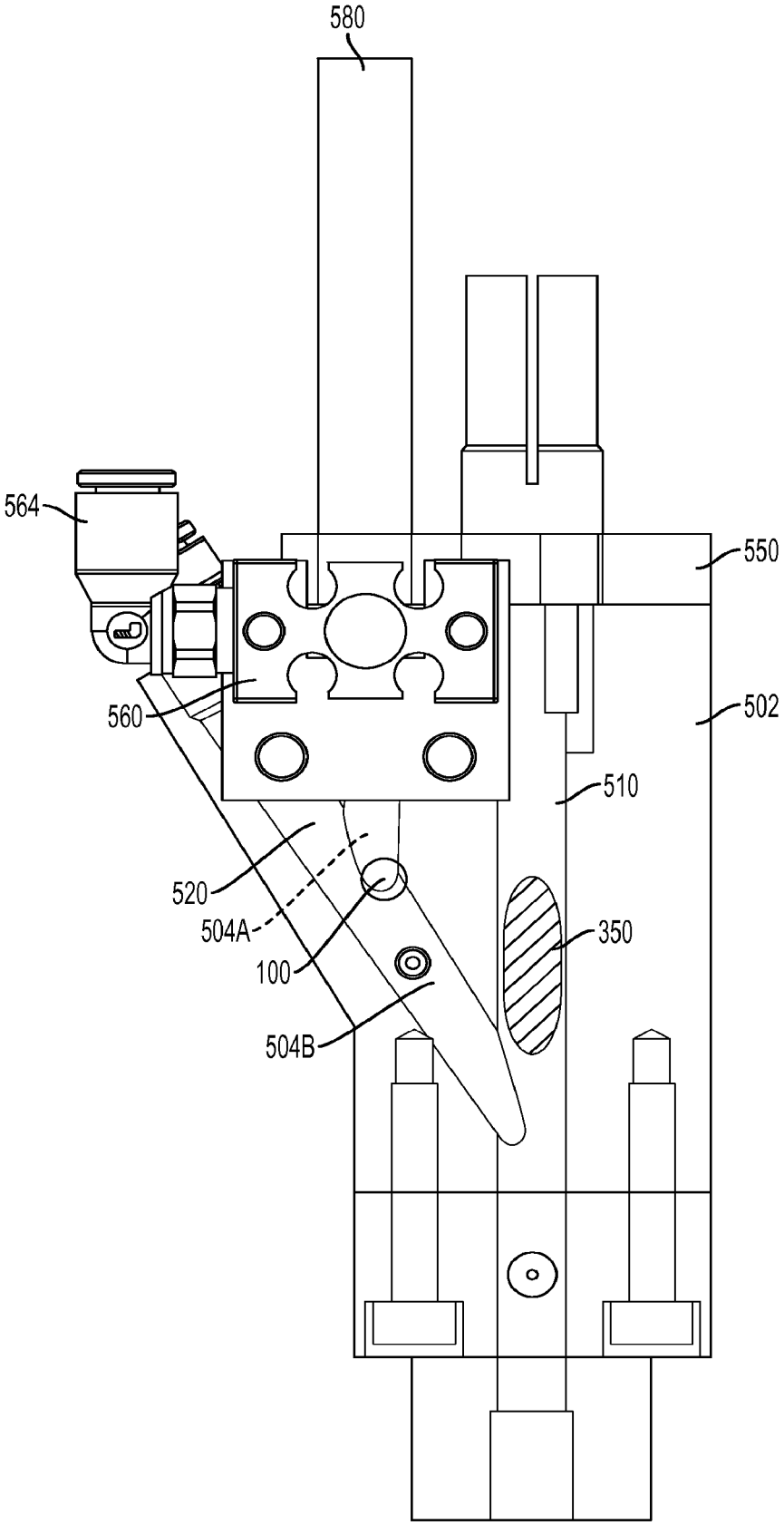
FIG. 13 is a side schematic view of the object insertion unit of FIG. 9, with phantom lines illustrating the internal structure and components of the object insertion unit.
Figure 14:
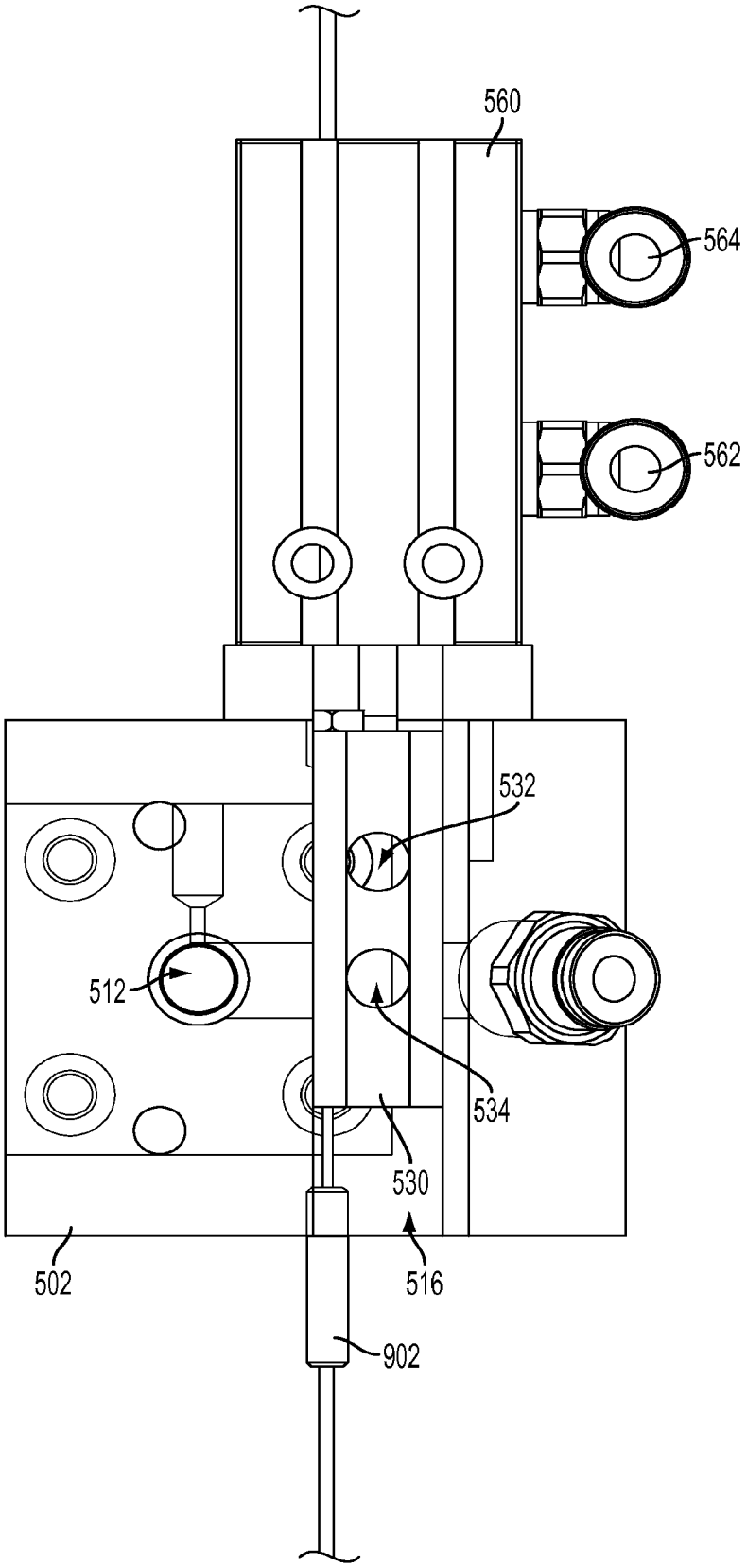
FIG. 14 is schematic plan view of the object insertion unit of FIG. 9, with phantom lines illustrating the internal structure of the object insertion unit.
Figure 17:
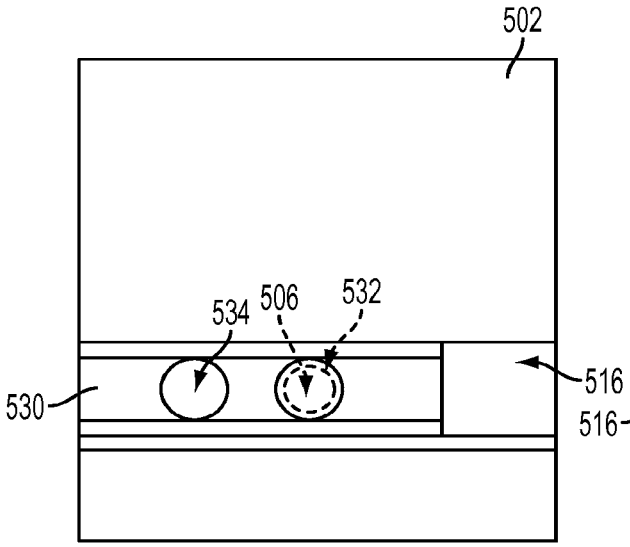
FIG. 17 is a schematic plan view of an object insertion unit with a translating member in a first dispensing position, according to one aspect of the present disclosure.
Figure 18:
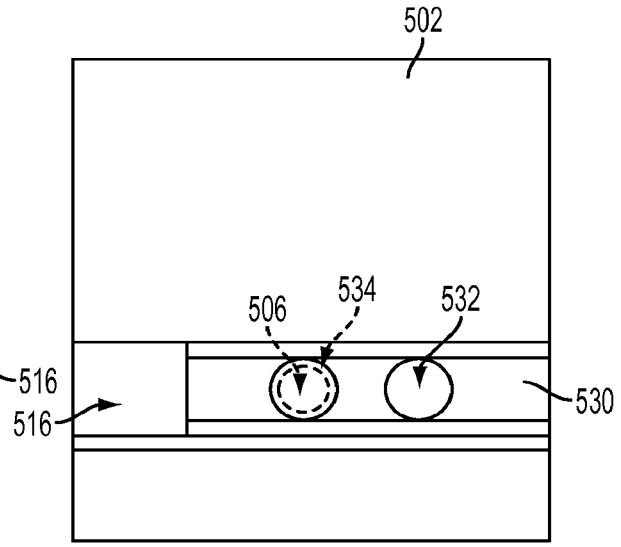
FIG. 18 is a schematic plan view of an object insertion unit with a translating member in a second dispensing position, according to one aspect of the present disclosure.

When in the first position, as shown in FIG. 17, the translating member 530 may be configured to receive an object from a connector tube 580 connected to the tubular transport members 702 in communication with the hopper assembly 700 and into the first port 532 in a non-dispensing position, wherein the first port 532 is not aligned with the object inlet 506. That is, in the first position, the first port 532 is disposed adjacent to a solid portion of the distribution channel 516, wherein the first port 532 and the distribution channel 516 thus cooperate to retain an object therein without the object being dispensed into the object inlet 506. Further, in the first position, the second port 534 is aligned with the object inlet 506 such that any object carried within the second port 534 is capable of being inserted into the object channel 504 through the object inlet 506. The translating member 530 may further be configured to be movable along the longitudinal axis 540 to the second position (FIG. 18), wherein the first port 532 becomes aligned with the object inlet 506 such that any object 100 carried within the first port 532 (and dispensed therein when the first port 532 was disposed in the first position) is dispensed into the object channel 504. Further, in the second position, the second port 534 is not aligned with the object inlet 506. That is, in the second position, the second port 534 is disposed adjacent to a solid portion of the distribution channel 516, wherein the second port 534 and the distribution channel 516 thus cooperate to retain an object therein without the object being dispensed into the object inlet 506 from a connector tube 580 connected to the tubular transport members 702 in communication with the hopper assembly 700. As such, when one of the first and second ports 532, 534 is aligned with the object inlet 506, the other of the first and second ports 532, 534 is positioned to receive an object 100 from one of the tubular transport members 702 of the object hopper assembly 700, via a corresponding connector tube 580. In this manner, the translating member 530 can act, for example, as a metering device which can be adjusted to selectively meter the objects 100 into the object channel 504. As shown in FIG. 9, the objects 100 may be continuously disposed in the tubular transport members 702 such that a constant supply of objects 100 is provided for introduction into the object insertion unit 500.

According to one aspect, the body member 502 may further define a second supplemental channel 508 extending to the distribution channel 516, opposite to the object inlet 506, such that the translating member 530 is disposed therebetween, as shown in FIG. 9. In this regard, the second supplemental channel 508 may be aligned with the object inlet 506, when either of the first and second ports 532, 534 of the translating member 530 is aligned with the object inlet 506. In this manner, an airflow or otherwise, pressurized air from a suitable source. may be directed through the second supplemental channel 508 and into the object channel 504, toward the tobacco channel 510, so as to urge the objects from the port 532, 534 aligned with the object inlet 506 and into and through the object channel 504. The second supplemental channel 508 may be in communication with a blower assembly (not shown) or other suitable air supply device or supply source of pressurized air via a tubular member 509.

In this regard, the body member 502 may also define first and second object delivery ports 582, 584 extending to the distribution channel 516. In operation, the first object delivery port 582 may be aligned with the first port 532 defined by the translating member 530, when the translating member 530 is disposed in the first position (i.e., a non-dispensing position). Similarly, the second object delivery port 584 may be aligned with the second port 534 defined by the translating member 530, when the translating member 530 is disposed in the second position (i.e., a non-dispensing position. When in the non-dispensing position, each of the first and second ports 532, 534 may receive at least one of the objects from the respective object delivery port 582, 584. Further, as the translating member 530 oscillates between the first and second positions, the objects may be directed from the respective ports 532, 534, into the object channel 504 and toward the tobacco channel 510, by the airflow directed through the supplemental channel 508, when either of the first and second ports 532, 534 is aligned with the object inlet 506.

In some instances, the portion of the body member 502 defining the supplemental channel 508 and first and second delivery ports 582, 584 may be integrally formed with the other portions of the body member 502. In other instances, a discrete cap member 550 may be attached to the body member 502 via fasteners 650 such that the distribution channel 516 cooperates with the cap member 550 to form and enclosed passageway. The cap member 550 may define the second supplemental channel 508, as well as the first and second object delivery ports 582, 584. The first and second object delivery ports 582, 584 may be configured to receive the connector tubes 580 connected to the tubular transport members 702 with connector members 590, so as to be in communication with the hopper assembly 700. The first and second ports 532, 534 align with the respective delivery port 582, 584 as the translating member 530, as the translating member 530 oscillates between the first and second positions such that objects can be received within the first and second ports 532, 534. In some instances, by utilizing more than one port (i.e., first and second ports 532, 534), the object insertion unit 500 may be capable of inserting different objects within each pouch member portion 116. That is, each port 532, 534 may supply a different type of object to the continuous tubular member 25.

The object insertion unit 500 may also include a switching device 560 for effecting oscillatory translation/movement of the translating member 530 within the distribution channel 516. For example, in one aspect, the translating device 560 may be a pressurized-air valve switching device in fluid communication with the translating member 530, wherein periodic re-direction of the pressurized air by the switching device 560 causes the translating member 530 to laterally translate in an oscillatory manner between two end points defining the first and second positions. More particularly, the switching device 560 may be configured to oscillate the translating member 530 axially along the distribution channel 516 and between the first and second dispensing positions by mechanically moving the translating member 530.

In this regard, a push rod (not shown) may be engaged with or mechanically linked to one of the bores 536, 538 defined by the translating member 530. The push rod may be disposed within the switching device 560 such that the push rod may be pneumatically oscillated therewithin to effect translation of the translating member 530. As such, when the push rod engages with one of the bores (e.g., bore 536) it forces the translating member 530 toward one of the first and second positions. A subsequent engagement of bore 536 by the push rod moving in the opposite or return direction causes the translating member 530 to be forced toward the other of the first and second positions.

One skilled in the art will appreciate, however, that the oscillatory mechanism disclosed herein is merely exemplary, since other mechanisms for oscillating the translating member 530 may be employed, including, for example, mechanical, electrical, and pneumatic mechanisms. For example, the switching device 560 may be configured to oscillate the translating member 530 axially along the distribution channel 516 and between the first and second dispensing positions by directing pulses of air into bores 536, 538 defined by the translating member 530. In this regard, the bores 536, 538 may be in fluid communication with air ports 562, 564 such that a pulse of air directed into one of air ports 562, 564 can travel into one of the bores 536, 538 to force the translating member 530 toward one of the first and second positions. A subsequent pulse of air may then be directed into the other of the air ports 562 such that the translating member 530 is forced toward the other of the first and second positions.

According to some aspects, a detection system 950 may be provided for sensing or otherwise detecting objects 100 being dispensed through the object channel 504. The detection system 950 may include one or more sensor devices 902 in communication with a computer detection device 904. In this manner, the sensor device 902 can detect the presence and/or absence of an object 100 and generate a corresponding signal sent to the computer detection device 904. For example, the sensor devices 902 may be fiber optic sensors capable of determining whether an object 100 is dispensed through the object channel 504. In other instances, the sensor device 902 may be configured to measure microwave density of the object dispensed through the object channel 504. Still in other instances, the sensor device 902 may be capable of detecting whether an object is leaking its payload by being configured to sense an ultraviolet (UV) tracer included in the object. Other detection systems as known by those of ordinary skill in the art may be employed for determining, for example, the absence and/or presence of objects, object defects, and other detectable object properties.

Figure 19:
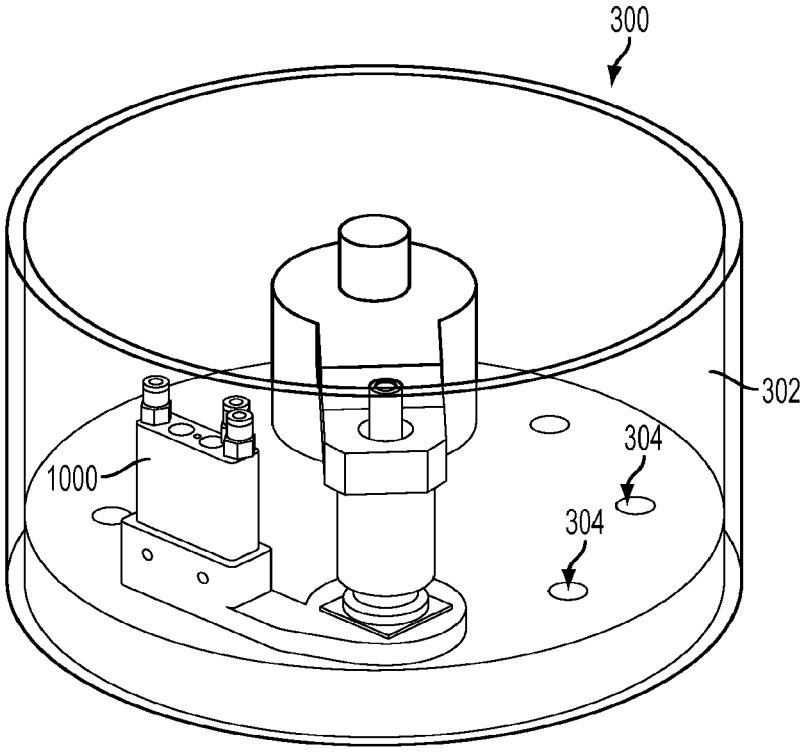
FIG. 19 is a schematic perspective view of an object insertion unit in communication with a tobacco insertion unit, according to one aspect of the present disclosure.

According to another aspect of the present disclosure, as shown in FIG. 19, the tobacco insertion unit 300 may include an object delivery unit 1000 engaged with the tobacco hopper 302, in addition to or instead of the previously-disclosed object insertion unit 500. The object delivery unit 1000 may be configured to deliver at least one of the objects 100 into each of the cavities 304 within the tobacco hopper 302 such that at least one of the objects 100 is directed, in conjunction with the tobacco material 350 received in the cavity 304, through the tobacco channel 510 and into the continuous tubular member 25. In this regard, such a configuration includes an arrangement for transporting the objects 100 together with the tobacco material as a single charge through the tobacco channel 510 of the object insertion unit 500. In other instances, the object insertion unit 500 may be circumvented or otherwise deleted such that the objects 100 and tobacco material charge are directed from the tobacco insertion unit 300 directly to the continuous tubular member 25 without passing through the object insertion unit 500. In any event, the objects 100 may, in these instances, be included with the tobacco material charge by way of the tobacco insertion unit 300, rather than by way of the object insertion unit 500 (i.e., via the object channel 504.

Referring to FIG. 20, there is shown one aspect of a smokeless tobacco product 110 capable of being formed in accordance with various aspects of the present disclosure. The tobacco product 110 includes a pouch member portion 116. In some instances, the pouch member portion 116 may comprise a moisture permeable mesh material. The illustrated pouch member portion 116 is sealed closed at its opposite ends 162, 165 (e.g., by heat-sealing, a suitable adhesive, or other suitable sealing mechanism) with the closing and dividing unit 600. According to some aspects, the pouch member portion 116 may be sealed closed along its length (i.e., longitudinally) along an overlap region, wherein the overlap region may be formed by sealing an inner surface portion of one lateral edge of the pouch member portion 116 over an outer surface portion of the opposite lateral edge of the pouch material (e.g., by heat sealing, suitable adhesive, or other suitable mechanism). In other aspects, the pouch member portion 116 may be seamlessly formed.

A tobacco material 130 is disposed within the pouch member portion 116. Also disposed within the pouch 116 is at least one object 134 such as, for example, a spherical capsule. In one aspect, the object 134 has an outer shell 138 that contains an inner payload 141. During a preferred use of the smokeless tobacco product 110, the object 134 may be ruptured and its contents 141 dispersed within the tobacco material 130 within the pouch member portion 116. The capsule payload 141 may be a flavor-containing liquid, as further described herein.

In some instances, the object 134 may be positioned proximate to one of the ends 162, 165 of the pouch member portion 116. For example, the object 134 may be disposed proximate to end 165, which corresponds to the trailing end 165 of a pouch member portion 116 of the continuous tubular member 25, as previously described. In this regard, at least a portion of the tobacco material 130 may be inserted into the pouch member portion 116 prior to insertion of the object 134 such that the tobacco material 130 can act as a cushion for the object 134 during insertion thereof. In this manner, the likelihood of rupturing or otherwise damaging the object 134 during insertion into the continuous tubular member 25 or otherwise during the closing and dividing of the pouch member portion 116 may be reduced.

Referring to FIG. 21, there is shown another aspect of a smokeless tobacco product 210 capable of being formed in accordance with various aspects of the present disclosure. The tobacco product 210 includes a pouch member portion 216, which may comprise a moisture permeable mesh material. The illustrated pouch member portion 216 may be sealed shut at its opposed ends 262, 265 (e.g., by heat-sealing, a suitable adhesive, or other suitable sealing mechanism) with the closing and dividing unit 600. A tobacco material 230 is contained within the pouch member portion 216. Also contained within the pouch member portion 216 is a plurality of objects 234, 235 such as, for example, two or more spherical capsules. Each of the objects 234, 244 has an outer shell 238, 248 that contains an inner payload 241, 251. The capsule payload 241, 251 may be a flavor-containing liquid, as further described herein.

Referring to FIG. 22, there is shown yet another aspect of a smokeless tobacco product 410 capable of being formed in accordance with various aspects of the present disclosure. The tobacco product 410 includes a pouch member portion 416, which may comprise a moisture permeable mesh material. The illustrated pouch member portion 416 may be sealed shut at its opposed ends 462, 465 (e.g., by heat-sealing, a suitable adhesive, or other suitable sealing mechanism) with the closing and dividing unit 600. A tobacco material 430 is disposed within the pouch member portion 416. Also contained within the pouch member portion 416 is a plurality of microcapsules 434 (not shown to scale). The microcapsules 434 may be of uniform or varied size and may comprise one or more flavoring ingredients, as further described herein.

The tobacco used for the manufacture of tobacco products pursuant to the present disclosure may vary. Such tobacco may include various types of tobaccos such as flue-cured tobacco, burley tobacco, Oriental tobacco, Maryland tobacco, dark tobacco, dark-fired tobacco and Rustica tobacco, as well as other rare or specialty tobaccos. Descriptions of various types of tobaccos, growing practices, harvesting practices and curing practices are set forth in Tobacco Production, Chemistry and Technology, Davis et al. (Eds.) (1999), which is incorporated herein by reference. See, also, the types of tobaccos that are set forth in U.S. Pat. No. 4,660,577 to Sensabaugh, Jr. et al.; U.S. Pat. No. 5,387,416 to White et al.; U.S. Pat. No. 6,730,832 to Dominguez et al.; and U.S. Pat. No. 7,025,066 to Lawson et al., each of which is incorporated herein by reference. Most preferably, the tobacco materials are those that have been appropriately cured and aged. Especially preferred techniques and conditions for flue-curing tobacco are set forth in Nestor et al., Beitrage Tabakforsch. Int., 20 (2003) 467-475 and U.S. Pat. No. 6,895,974 to Peele, which are incorporated herein by reference. Representative techniques and conditions for air curing tobacco are set forth in Roton et al., Beitrage Tabakforsch. Int., 21 (2005) 305-320 and Staaf et al., Beitrage Tabakforsch. Int., 21 (2005) 321-330, which are incorporated herein by reference.

Tobacco products of the present disclosure, such as the aspects illustrated in FIGS. 20-22, may incorporate one type of tobacco (e.g., in a so-called "straight grade" form). For example, the tobacco within a tobacco product may be composed solely of flue-cured tobacco (e.g., all of the tobacco may be composed of, or derived from, either flue-cured tobacco lamina or a mixture of flue-cured tobacco lamina and flue-cured tobacco stem). The tobacco within a tobacco product also may have a so-called "blended" form. For example, the tobacco within a tobacco product may be composed of a mixture of parts or pieces of flue-cured burley (e.g., Malawi burley tobacco) and Oriental tobaccos (e.g., as tobacco composed of, or derived from, tobacco lamina, or a mixture of tobacco lamina and tobacco stem). For example, a representative blend may incorporate about 30 to about 70 parts burley tobacco (e.g., lamina, or lamina and stem), and about 30 to about 70 parts flue cured tobacco (e.g., stem, lamina, or lamina and stem) on a dry weight basis. Other exemplary tobacco blends incorporate about 75 parts flue-cured tobacco, about 15 parts burley tobacco and about 10 parts Oriental tobacco; or about 65 parts flue-cured tobacco, about 25 parts burley tobacco and about 10 parts Oriental tobacco; or about 65 parts flue-cured tobacco, about 10 parts burley tobacco and about 25 parts Oriental tobacco; on a dry weight basis.

The tobacco used for the manufacture of the tobacco product preferably is provided in a shredded, ground, granulated, fine particulate or powder form. Most preferably, the tobacco is employed in the form of parts or pieces that have an average particle size less than that of the parts or pieces of shredded tobacco used in so-called "fine cut" tobacco products. Typically, the very finely divided tobacco particles or pieces are sized to pass through a screen of about 18 Tyler mesh, generally are sized to pass a screen of about 20 Tyler mesh, often are sized to pass through a screen of about 50 Tyler mesh, frequently are sized to pass through a screen of about 60 Tyler mesh, may even be sized to pass through a screen of 100 Tyler mesh, and further may be sized so as to pass through a screen of 200 Tyler mesh. If desired, air classification equipment may be used to ensure that small sized tobacco particles of the desired sizes, or range of sizes, may be collected. If desired, differently sized pieces of granulated tobacco may be mixed together.

The composition/construction of a moisture-permeable packet or pouch that acts as a container for use of the tobacco formulation, such as the pouch member portions 116, 216, 416 in the aspects illustrated in FIGS. 20-22, may be varied. Suitable packets, pouches or containers of the type used for the manufacture of smokeless tobacco products are available under the tradenames CatchDry, Ettan, General, Granit, Goteborgs Rape, Grovsnus White, Metropol Kaktus, Mocca Anis, Mocca Mint, Mocca Wintergreen, Kicks, Probe, Prince, Skruf and TreAnkrare. The tobacco formulation may be contained in pouches and packaged in a manner and using the types of components used for the manufacture of conventional snus types of products. The pouch provides a liquid-permeable container of a type that may be considered to be similar in character to the mesh-like type of material that is used for the construction of a tea bag. Components of the loosely arranged, granular tobacco formulation readily diffuse through the pouch and into the mouth of the user.

An exemplary pouch member portion 116, 216, 416 may be manufactured from materials, and in such a manner, such that during use by the user, the pouch undergoes a controlled dispersion or dissolution. Such pouch materials may have the form of a mesh, screen, perforated paper, permeable fabric, or the like. For example, pouch material manufactured from a mesh-like form of rice paper, or perforated rice paper, may dissolve in the mouth of the user. As a result, the pouch and tobacco formulation each may undergo complete dispersion within the mouth of the user during normal conditions of use, and hence the pouch and tobacco formulation both may be ingested by the user. Other exemplary pouch materials may be manufactured using water dispersible film forming materials (e.g., binding agents such as alginates, carboxymethylcellulose, xanthan gum, pullulan, and the like), as well as those materials in combination with materials such as ground cellulosics (e.g., fine particle size wood pulp). Preferred pouch materials, though water dispersible or dissolvable, may be designed and manufactured such that under conditions of normal use, a significant amount of the tobacco formulation contents permeate through the pouch material prior to the time that the pouch undergoes loss of its physical integrity. If desired, flavoring ingredients, disintegration aids, and other desired components, may be incorporated within, or applied to, the pouch material.

The amount of tobacco formulation contained within each pouch may vary. In smaller aspects, the dry weight of the tobacco formulation within each pouch is at least about 50 mg to about 150 mg. For a larger aspect, the dry weight of the tobacco formulation within each pouch preferably does not exceed about 300 mg to about 500 mg.

Each pouch member portion 116, 216, 416 may have disposed therein at least one object such as, for example, a flavor agent member. As used herein, a flavor agent member is an object containing a flavoring ingredient (as used herein, the terms "flavorant" and "flavoring ingredient" refer to substances, such as liquids or solids, that provide a concentrated release providing a sensory effect such as, for example, taste, mouthfeel, moistness, coolness/heat, and/or fragrance). The object may include capsules, microcapsules, beads, pellets, rods, strands, sheets, strips, or other shaped items or combinations thereof designed to deliver a predetermined, concentrated amount of a flavoring ingredient to the user. For example, representative types of materials and ingredients useful for the manufacture of essentially water insoluble flavored beads, strands or pellets may be found within the filters of cigarettes available as Camel Dark Mint, Camel Mandarin Mint, Camel Spice Crema, Camel Izmir Stinger, Camel Spice Twist, Camel Mandalay Lime and Camel Aegean Spice by R.J. Reynolds Tobacco Company. The object preferably is shaped, sized, and of a texture that provides for comfortable and convenient use.

In some instances, the objects may be synthetically formed structures rather than food-like objects. The object may be hollow with a payload in the hollow portion comprising the flavoring ingredient. The object may be solid with the flavoring ingredient incorporated into the composition forming the solid object and releasable by dissolving or disintegrating the solid object. According to some aspects, the flavor agent member is a hollow capsule carrying a payload comprising a flavoring ingredient. Other object configurations may be used alone or in combination with a hollow capsule. Optionally, combinations of different forms of a flavor agent member may be used to deliver combinations of different flavors or the same flavors. Each form of a flavor agent member may be tailored to provide different release characteristics of the flavoring ingredient(s) such as, for example, quick-release, delayed release, sustained release, or a combination thereof.

In accordance with aspects of the present disclosure, at least one object is incorporated within each pouch member portion 116, 216, 416. For example, as shown in the aspect illustrated in FIG. 20, a single object 134 may be included within each pouch member portion 116. In other instances, and as shown in the aspect illustrated in FIG. 21, a plurality of objects 234, 244 may be included within each pouch member portion 216. For example, two or more objects may be included in each pouch member portion 216, and the number of objects in each pouch member portion 216 may be selected based upon factors including the size of the pouch member portion 216, the amount and type of tobacco within the pouch member portion 216, the object size, the desired mouthfeel, the desired sensory effect (e.g., taste, coolness/warmth), and/or the like. If desired, objects of different sizes and/or of different types (e.g., differing shell materials, differing shell properties such as shape or hardness and/or differing capsule-contained components) may be incorporated within the product. In this manner, different objects may be incorporated into the product to provide desired properties (e.g., mouthfeel, flavor, other sensory effect), and/or to provide release of encapsulated components at different times during the use of the product. For example, a first flavoring ingredient may be released from a first set of objects upon initial introduction of the product to a user's mouth, and a second flavoring ingredient, contained in a second set of objects, may not be released until a later time (e.g., a semi-soluble coating of the second objects takes longer to rupture than the coating of the first object set).

The size and weight of each object may vary depending upon the desired properties it is to impart to the tobacco product. In some instances, the objects are generally spherical in shape. However, suitable objects may have other types of shapes, such as generally rectilinear, oblong, elliptical, or oval shapes. Exemplary smaller spherical objects may have diameters of at least about 0.5 mm, generally at least about 1 mm, often at least about 2 mm, and frequently at least about 3 mm. Exemplary larger spherical objects may have diameters of less than about 6 mm, and often less than about 5 mm. Exemplary smaller individual objects may weigh at least about 5 mg, often at least about 15 mg, and frequently at least about 25 mg. Exemplary larger individual objects may weigh less than about 75 mg, generally less than about 65 mg, and often less than about 55 mg.

In certain aspects, a plurality of very small objects, commonly referred to as "microcapsules" may be incorporated within the product, as shown in FIG. 22. That is, at least one object within the tobacco product may be of a microcapsule form. The number of microcapsules within the product may vary. In some instances, the number of microcapsules incorporated within the product may exceed about 10, and may even exceed about 100. Exemplary microcapsules may have diameters of less than 100 microns and may have outer shells that are gelatin based, cyclodextrin based, or the like. For example, exemplary types of microcapsule technologies are of the representative type set forth in Kondo, Microcapsule Processing and Technology, ISBN 0824768574 (1979); Iwamoto et al., AAPS Pharm. Sci. Tech. 2002 3(3): article 25; and U.S. Pat. No. 3,550,598 to McGlumphy and U.S. Pat. No. 6,117,455 to Takada et al., each of which is incorporated herein by reference.

According to some aspects, the objects do not incorporate any tobacco within their outer shells, or within their inner payload regions. However, if desired, other aspects of objects may incorporate tobacco (e.g., as finely group tobacco pieces and/or tobacco extracts) within their outer shells and/or within their inner payload regions. The components of the object inner payload may provide a desired alteration to the sensory attributes of the smokeless tobacco product such as, for example, smell, flavor, and/or mouthfeel.

The weight of the contents within the pouch member portion provided by the object(s) may vary. Typically, the dry weight of the tobacco within the tobacco product may be greater than the weight provided by object(s). However, representative tobacco products may include tobacco and at least one object such that the weight of the object ranges from about 10 percent to about 75 percent, often about 20 percent to about 50 percent, based on the combined weight of object(s) and dry weight of tobacco.

Representative types of objects are of the type commercially available as "Momints" by Yosha! Enterprises, Inc. and "Ice Breakers Liquid Ice" from The Hershey Company. Representative types of objects also have been incorporated in chewing gum, such as the type of gum marketed under the tradename "Cinnaburst" by Cadbury Adams USA. Representative types of objects and components thereof also are set forth in U.S. Pat. No. 3,339,558 to Waterbury; U.S. Pat. No. 3,390,686 to Irby, Jr. et al.; U.S. Pat. No. 3,685,521 to Dock; U.S. Pat. No. 3,916,914 to Brooks et al.; U.S. Pat. No. 4,889,144 to Tateno et al. and U.S. Pat. No. 6,631,722 to MacAdam et al.; US Pat. Pub. No. 2004/0261807 to Dube et al.; and PCT Application WO 03/009711 to Kim; which are incorporated herein by reference. See also, the types of objects and components thereof set forth in U.S. Pat. No. 5,223,185 to Takei et al.; U.S. Pat. No. 5,387,093 to Takei;

U.S. Pat. No. 5,882,680 to Suzuki et al.; U.S. Pat. No. 6,719,933 to Nakamura et al.; U.S. Pat. No. 6,949,256 to Fonkwe et al. and U.S. Pat. No. 7,754,239 to Mane et al.; and U.S. Pat. App. Pub. Nos. 2004/0224020 to Schoenhard; 2005/0196437 to Bednarz et al. and 2005/0249676 to Scott et al.; which are incorporated herein by reference. The objects may be colored, provided with smooth or rough surfaces, have rigid or pliant shells, have brittle or durable shells, or other desired features or characters.

An exemplary object may include an outer shell incorporating a material such as gelatin, and an inner payload region incorporating at least one flavoring ingredient and a triglyceride liquid. Exemplary types of flavoring ingredients include those set forth above with reference to the types of flavoring ingredients for the tobacco formulation. Thus, for example, such an object may be incorporated into the pouch member portion along with the tobacco formulation. During use, contact of the object with moisture present in the user's mouth may cause the object to soften, lose its physical integrity, and release the flavoring ingredients within the user's mouth. In other instances, the object may be purposefully crushed by application of pressure to release the flavoring ingredients. Such a release of flavoring ingredient may alter or enhance the flavor of the product, as well as extending the period of time that a user may enjoy the product.

An exemplary object, such as, for example, the object 134 depicted in FIG. 20, may include an outer shell incorporating a material such as wax, and an inner payload incorporating an aqueous or non-aqueous liquid (e.g., a solution or dispersion of at least one flavoring ingredient within water or an organic liquid such as an alcohol or oil, or a mixture of water and a miscible liquid like alcohol or glycerin). Thus, for example, such an object may be incorporated within the pouch member portion 116 along with the tobacco formulation. During use of the product, a crushing or other physical destruction of the capsule may allow the capsule to release the moisture contained therein to provide suitable moistening of components of the tobacco formulation. For example, a suitable number of objects having outer shells comprising a food grade waxy substance and an inner payload comprising water may be incorporated within the pouch member portion 116 such that, upon rupture of those objects, sufficient water is released to provide a desired moistening effect upon the tobacco formulation. For example, about 150 mg of a tobacco formulation having moisture content of about 8 weight percent to about 10 weight percent may be contained within the pouch member portion 116 containing about three water-filled objects with outer shells comprising wax, wherein each object contains about 20 mg to about 30 mg of water. Exemplary types of waxes include ChevronTexaco Refined Waxes 128 and 141 (available from Chevron Corporation) and waxes produced using the wax hydrofining process of ExxonMobil Corporation. Such a release of moistening agent from the objects may alter or enhance the sensory attributes (e.g., flavor and organoleptic characteristics) of the product, and may also extend the time for which a user may wish to keep the product in his mouth.

In some instances, the object 134 may include an outer shell incorporating a material such as wax or gelatin, wherein the object 134 may be subsequently coated with a thin layer of a waterproofing material such as, for example, food-grade shellac, hard wax, ethyl cellulose, or other suitable material. Such a waterproofing layer may provide moisture resistance such that the object 134 can withstand, for example, 20%-60% moisture of the tobacco material itself. Further, the waterproofing layer may also resist softening or dissolution insider the user's mouth during initial use prior to activating (e.g., crushing) the object 134.

If desired, other components also may be contained within each pouch member portion 116. For example, at least one flavored strip, piece or sheet of flavored water dispersible or water soluble material (e.g., a breath-freshening edible film type of material) may be disposed within each pouch member portion 116 along with or without at least one object. Such strips or sheets may be folded or crumpled in order to be readily incorporated within the pouch. See, for example, the types of materials and technologies set forth in U.S. Pat. No. 6,887,307 to Scott et al. and U.S. Pat. No. 6,923,981 to Leung et al.; and The EFSA Journal (2004) 85, 1-32; which are incorporated herein by reference.

Many modifications and other aspects of the disclosure set forth herein will come to mind to one skilled in the art to which this disclosure pertains having the benefit of the teachings presented in the foregoing descriptions and the associated drawings. Therefore, it is to be understood that the disclosure is not to be limited to the specific aspects disclosed and that modifications and other aspects are intended to be included within the scope of the appended claims. Although specific terms are employed herein, they are used in a generic and descriptive sense only and not for purposes of limitation.

That which is claimed:

1. A method for manufacturing a smokeless tobacco product, using an object insertion unit comprising a body member defining a tobacco channel extending therethough between a tobacco inlet and an outlet, and an object channel extending from an object inlet into communication with the tobacco channel between the tobacco inlet and the outlet, wherein the object inlet extends to a distribution channel defined by the body member, the object insertion unit further comprising a translating member configured to be received within the distribution channel and to be axially movable with respect to the distribution channel, along a longitudinal axis defined thereby, between a first position and a second position, the translating member defining first and second ports extending therethrough, each extending perpendicularly to the longitudinal axis, the method comprising:

forming a continuous supply of a pouch material into a continuous cylindrical tubular member using a forming unit, the tubular member defining a longitudinal axis;

introducing tobacco material into a pouch member portion of the tubular member using a tobacco insertion unit, the tobacco material being retained within the pouch member portion by a closed leading edge thereof;

introducing objects into the tubular member, using the object insertion unit, such that at least one of the objects is introduced into the pouch member portion, by:

receiving the objects via the object inlet and directing the objects into the tobacco channel, the tobacco channel being configured to receive the tobacco material via the tobacco inlet and the objects via the object channel;

directing the tobacco material and the objects to the outlet for introduction into the continuous tubular member; and oscillating the translating member between the first position, wherein the first port is disposed in a non-dispensing position not aligned with the object inlet and the second port is disposed in alignment with the object inlet, and the second position, wherein the first port is disposed in alignment with the object inlet and the second port is disposed in a non-dispensing position not aligned with the object inlet;

closing a first portion of the tubular member to form the closed leading edge of the pouch member portion and a closed trailing edge of a previous pouch member portion, prior to introducing the tobacco material and the at least one of the objects into the pouch member portion;

closing a second portion of the tubular member to form a closed trailing edge of the pouch member portion and a closed leading edge of a subsequent pouch member portion, after introducing the tobacco material and the at least one of the objects into the pouch member portion; and dividing the tubular member, between the closed trailing edge and the closed leading edge of the respective pouch members along the longitudinal axis of the tubular member, into a plurality of discrete pouch member portions such that each discrete pouch member portion includes the tobacco material and the at least one of the objects.

2. The method according to claim 1, wherein the body member further defines a supplemental channel extending to the distribution channel opposite to the object inlet such that the translating member is disposed therebetween, the supplemental channel being aligned with the object inlet, when either of the first and second ports is aligned with the object inlet and wherein introducing objects into the tubular member further comprises:

directing an airflow through the supplemental channel into the object channel and toward the tobacco channel.

3. The method according to claim 2, wherein the body member further defines first and second object delivery ports extending to the distribution channel, wherein, in the first position, the first object delivery port is aligned with the first port defined by the translating member and disposed in the non-dispensing position, and wherein, in the second position, the second object delivery port is aligned with the second port defined by the translating member and disposed in the non-dispensing position, and wherein introducing objects into the tubular member further comprises:

receiving at least one of the objects from the respective object delivery port in each of the first and second ports in the non-dispensing position; and directing the at least one of the objects from the respective ports into the object channel and toward the tobacco channel, using the airflow directed by the supplemental channel, when either of the first and second ports is aligned with the object inlet.

4. The method according to claim 3, wherein an object hopper assembly comprises an object hopper configured to receive the objects and an agitation device configured to interact with the object hopper, and wherein the method further comprises:

feeding objects from the object hopper to each of the first and second object delivery ports of the object insertion unit via at least one tubular transport member extending thereto; and agitating the objects within the object hopper with the agitation device so as to facilitate delivery of the objects into the at least one tubular transport member.

5. The method according to claim 4, wherein the object hopper and the at least one tubular transport member are coaxially disposed along a substantially vertical axis, and wherein the method further comprises:

oscillating one of the object hopper and the at least one tubular transport member with respect to the other along the substantially vertical axis, using the agitation device, such that at least one tubular transport member is oscillated to a minima below a fill level of the objects within the object hopper.

6. The method according to claim 1, wherein the tobacco insertion unit comprises a tobacco hopper for receiving the tobacco material, and defining a plurality of cavities arranged in a substantially circular formation, and wherein the method further comprises:

rotating an arm member operably engaged with the tobacco hopper to direct the tobacco material within the tobacco hopper into the cavities; and serially engaging each cavity defined by the tobacco hopper, using a charge delivery device engaged therewith, to direct the tobacco material therefrom through the tobacco channel and into the continuous tubular member.

7. The method according to claim 6, wherein the tobacco insertion unit further comprises an object delivery unit operably engaged with the tobacco hopper, and the method further comprises:

delivering at least one of the objects into each of the cavities, using the object delivery unit, such that the at least one of the objects is directed with the tobacco material received therein through the tobacco channel and into the continuous tubular member.

* * * * *